US005553678A

United States Patent [19]

Barr et al.

[11] Patent Number: 5,553,678

[45] Date of Patent: Sep. 10, 1996

[54] MODULATED BIAS UNITS FOR STEERABLE ROTARY DRILLING SYSTEMS

[75] Inventors: John D. Barr, Cheltenham; Mark W. Burrell, London; Robert A. Russell, Barnwood; Richard Thorp, Bristol; David Boast, Colerne; John Clegg, Redland, all of England

[73] Assignee: Camco International Inc., Houston, Tex.

[21] Appl. No.: 937,061

[22] Filed: Aug. 27, 1992

Related U.S. Application Data

[63] Continuation-in-part of Ser. No. 901,748, Jun. 22, 1992, Pat. No. 5,265,682.

[30] Foreign Application Priority Data

Aug. 30, 1991 [GB] United Kingdom ..... 9118618

[51] Int. Cl.[6] ..... E21B 7/08

[52] U.S. Cl. ..... 175/73; 175/324; 175/393

[58] Field of Search ..... 175/73, 324, 393, 175/61

[56] References Cited

U.S. PATENT DOCUMENTS

| | | | |
|---|---|---|---|
| 3,092,188 | 6/1963 | Farris et al. | 175/76 |
| 3,997,008 | 12/1976 | Kellner | 175/61 X |
| 4,211,292 | 7/1980 | Evans | 175/61 |
| 4,305,474 | 12/1981 | Farris et al. | 175/73 |
| 4,416,339 | 11/1983 | Baker et al. | 175/61 |
| 4,635,736 | 1/1987 | Shirley | 175/76 |
| 4,637,479 | 1/1987 | Leising | 175/26 |
| 4,886,130 | 12/1989 | Evans | 175/73 |
| 4,899,834 | 2/1990 | Weldon | 175/73 |
| 4,947,944 | 8/1990 | Coltman et al. | 175/73 |
| 5,000,272 | 3/1991 | Wiebe et al. | 175/73 |
| 5,265,682 | 11/1993 | Russell et al. | 175/45 |

FOREIGN PATENT DOCUMENTS

| | | |
|---|---|---|
| 459008 | 12/1991 | European Pat. Off. . |
| 2441553 | 5/1975 | Germany . |
| 2238336 | 5/1991 | United Kingdom . |
| 2246151 | 1/1992 | United Kingdom . |

*Primary Examiner*—Hoang C. Dang

[57] ABSTRACT

A modulated bias unit is provided for controlling the direction of drilling of a rotary drill bit when drilling boreholes in subsurface formations. The unit comprises a plurality of hydraulic actuators spaced apart around the periphery of the unit and having movable thrust members hydraulically displaceable outwardly for engagement with the formation of the borehole being drilled. Each actuator has an inlet passage for connection to a source of drilling fluid under pressure and an outlet passage for communication with the annulus. A selector control valve connects the inlet passages in succession to the source of fluid under pressure, as the unit rotates, and a choke is provided to create a pressure drop between the source of fluid under pressure and the selector valve. A further choke is provided in the outlet passage from each actuator unit. The actuators and control valve arrangements may take a number of different forms.

35 Claims, 14 Drawing Sheets

FIG 15
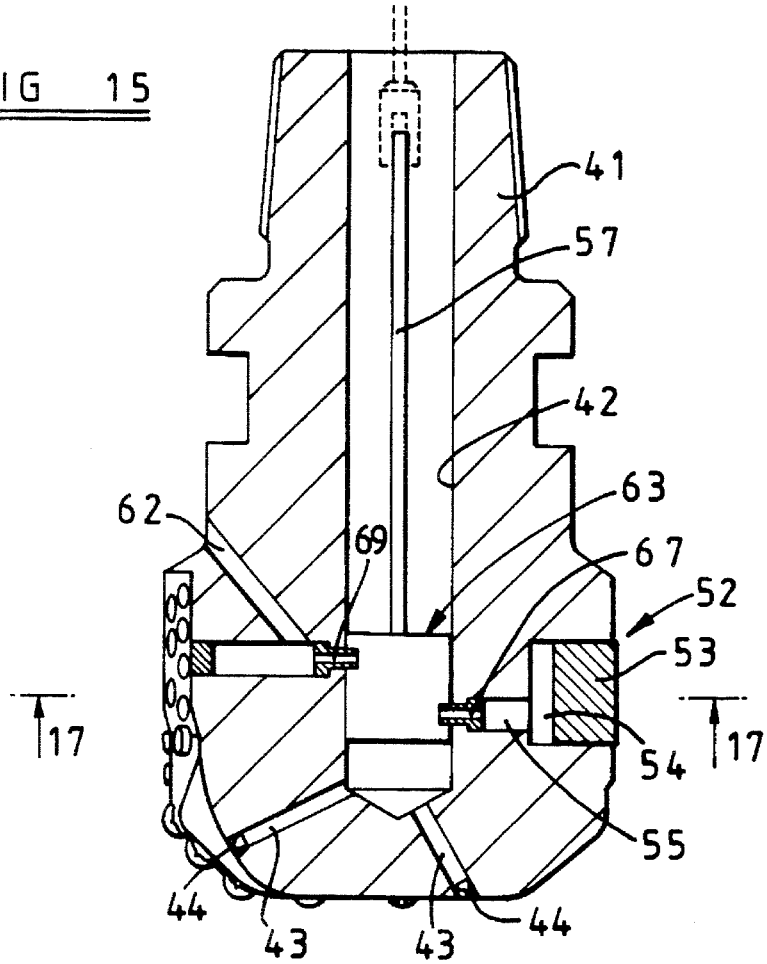
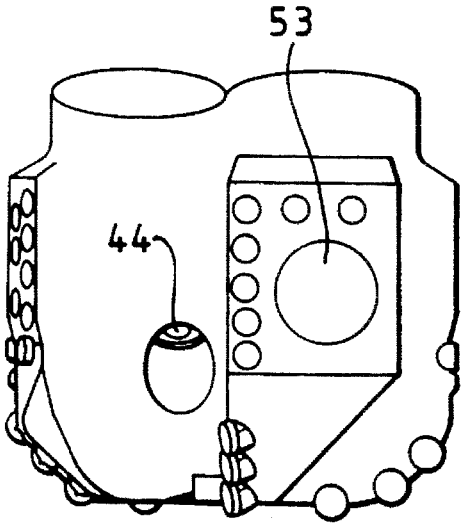
FIG 16
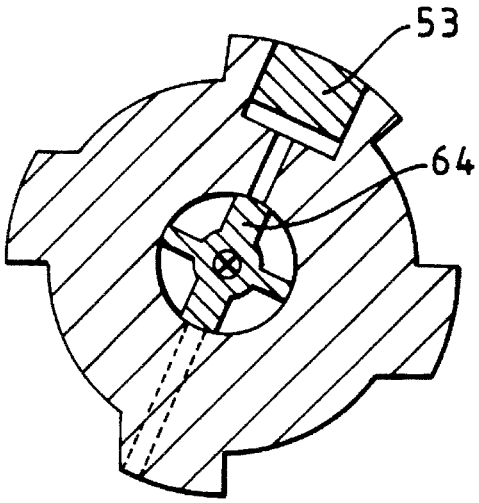
FIG 17

FIG 24
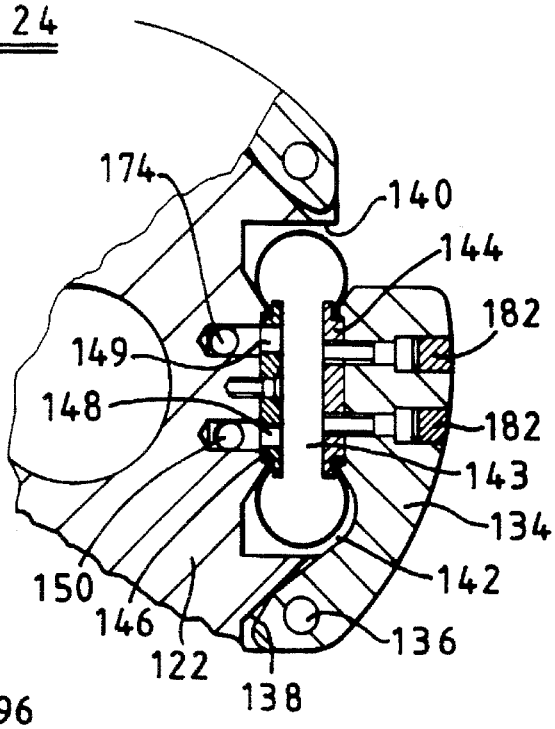
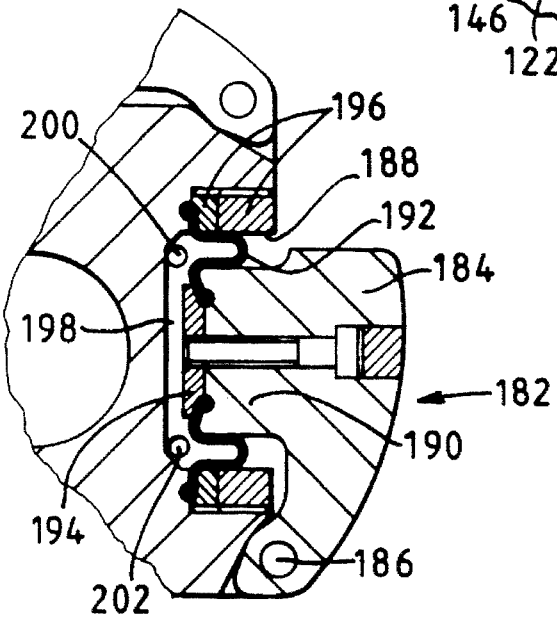
FIG 25
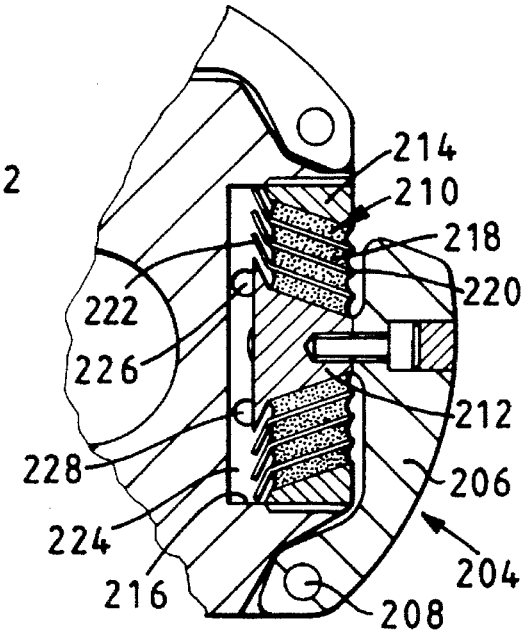
FIG 26

MODULATED BIAS UNITS FOR STEERABLE ROTARY DRILLING SYSTEMS

CROSS-REFERENCE TO RELATED APPLICATION

This application is a continuation-in-part of U.S. application Ser. No. 901,748, filed on Jun. 22, 1992, now U.S. Pat. No. 5,265,682.

BACKGROUND OF THE INVENTION

When drilling or coring holes in sub-surface formations, it is sometimes desirable to be able to vary and control the direction of drilling, for example to direct the borehole towards a desired target, or control the direction horizontally within the payzone once the target has been reached. It may also be desirable to correct for deviations from the desired direction when drilling a straight hole, or to control the direction of the hole to avoid obstacles.

"Rotary drilling" is defined as a system in which a downhole assembly, including the drill bit, is connected to a drill string which is rotatably driven from the drilling platform. The established methods of directional control during rotary drilling involve variations in bit weight, r.p.m. and stabilisation. However, the directional control which can be exercised by these methods is limited and conflicts with optimising bit performance. Hitherto, therefore, fully controllable directional drilling has normally required the drill bit to be rotated by a downhole motor, either a turbine or PDM (positive displacement motor). The drill bit may then, for example, be coupled to the motor by a double tilt unit whereby the central axis of the drill bit is inclined to the axis of the motor. During normal drilling the effect of this inclination is nullified by continual rotation of the drill string, and hence the motor casing, as the bit is rotated by the motor. When variation of the direction of drilling is required, the rotation of the drill string is stopped with the bit tilted in the required direction. Continued rotation of the drill bit by the motor then causes the bit to drill in that direction.

The instantaneous rotational orientation the motor casing is sensed by survey instruments carried adjacent the motor and the required rotational orientation of the motor casing for drilling in the appropriate direction is set by rotational positioning of the drill string, from the drilling platform, in response to the information received in signals from the downhole survey instruments. A similar effect to the use of a double tilt unit may be achieved by the use of a "bent" motor, a "bent" sub-assembly above or below the motor, or an offset stabiliser on the outside of the motor casing. In each case the effect is nullified during normal drilling by continual rotation of the drill string, such rotation being stopped when deviation of the drilling direction is required.

Although such arrangements allow accurately controlled directional drilling to be achieved, using a downhole motor to drive the drill bit, there are reasons why rotary drilling is to be preferred.

Thus, rotary drilling is generally less costly than drilling with a downhole motor. Not only are the motor units themselves costly, and require periodic replacement or refurbishment, but the higher torque at lower rotational speeds permitted by rotary drilling provide improved bit performance and hence lower drilling cost per foot.

Also, in steered motor drilling considerable difficulty may be experienced in accurately positioning the motor in the required rotational orientation, due to stick/slip rotation of the drill string in the borehole as attempts are made to orientate the motor by rotation of the drill string from the surface. Also, rotational orientation of the motor is affected by the wind-up in the drill string, which will vary according to the reactive torque from the motor and the angular compliance of the drill string.

Accordingly, some attention has been given to arrangements for achieving a fully steerable rotary drilling system.

For example, Patent Specification No. WE090/05235 describes a steerable rotary drilling system in which the drill bit is coupled to the lower end of the drill string through a universal joint which allows the bit to pivot relative to the string axis. The bit is contra-nutated in an orbit of fixed radius and at a rate equal to the drill string rotation but in the opposite direction. This speed-controlled and phase-controlled bit nutation keeps the bit heading off-axis in a fixed direction. Such arrangement requires the provision of a controlled servo of high power.

British Patent Specification No. 2246151 describes an alternative form of steerable rotary drilling system in which an asymmetrical drill bit is coupled to a mud hammer. The direction of the borehole is selected by selecting a particular phase relation between rotation of the drill bit and the periodic operation of the mud hammer.

British Patent Specifications Nos. 2172324 A, 2172325 A and 2177738 A (Cambridge Radiation Technology Limited) disclose arrangements in which lateral forces are applied to a drilling tube above the drill bit so as to impart a curvature to the drilling tube and thereby control the drilling direction. Such arrangements are complex and require large downhole assemblies.

U.S. Pat. No. 4,995,465 (J. L. Beck and L. D. Taylor) describes a rotary drilling system in which a bent-sub is connected behind the drill bit so that the bit extends angularly with respect to the drill rod. An actuator, such as an hydraulic ram, is provided at the surface for exerting thrust on the end of the drill rod which is transmitted along the rod to the drill bit. The thrust applied axially along the drill rod is pulsed to effect the desired trajectory of the drilling, the pulsing of the drill rod being based upon signals received from a downhole monitor.

U.S. Pat. No. 4,637,479 (L. J. Leising) describes a roller-cone bit carried on a drilling tool in which a rotating flow-obstructing member controls the flow of drilling fluid to discharge passages in the drill bit. By controlling the rate of rotation of the flow obstructing member, drilling fluid may be sequentially discharged from the bit passages into only a single peripheral sector of the borehole, thereby diverting the drill bit into a different path by eroding the formation in that sector.

our British Patent Application No. 9023465.7 refers to the use of an hydrostatic bearing, for example in the gauge section of a drill bit, to provide low-friction engagement between a bearing pad and the wall of the borehole. Such a low-friction bearing pad is required in certain arrangements for reducing or eliminating bit whirl.

U.S. Pat. No. 4,416,339 discloses a device for effecting deviation of a drill bit during rotary drilling, the device comprising a hinged paddle which may be urged outwardly from the drill string and toward the wall of the borehole by operation of a piston and cylinder device. Flow of fluid to and from the piston and cylinder device is controlled by an oscillating gate means which is responsive to the attitude and rotation of the bottomhole assembly, and is not positively controlled in synchronism with rotation of the drill bit.

U.S. Pat. No. Re. 29,526 discloses an arrangement where part of the bottomhole assembly comprises an external sleeve above the drill bit which is displaceable laterally by selectively inflating and deflating fluid filled bladders arranged around the inner periphery of the sleeve, the inflation and deflation of the bladders, and hence displacement the sleeve, being controlled in accordance with the orientation of a non-rotating pendulum mounted in the drill pipe.

SUMMARY OF THE INVENTION

The present invention sets out to provide improved forms of modulated bias units for use in steerable rotary drilling systems.

According to one aspect of the invention there is provided a modulated bias unit, for controlling the direction of drilling of a rotary drill bit when drilling boreholes in subsurface formations, comprising: a body structure having an outer peripheral surface: at least one cavity located at said outer peripheral surface; a movable thrust member partly projecting outwardly of said cavity for engagement with the surrounding formation of the borehole being drilled; means for supplying fluid under pressure to said cavity from a source of fluid under pressure to displace said movable member outwardly; and means for modulating the pressure of fluid supplied to the cavity in synchronism with rotation of the body structure, and in selected phase relation thereto, whereby said movable member is displaced outwardly at a selected rotational orientation of the body structure.

The invention also provides a modulated bias unit, for controlling the direction of drilling of a rotary drill bit when drilling boreholes in subsurface formations comprising: a body structure having an outer periphery; a plurality of hydraulic actuator units spaced apart around the periphery of the body structure and having movable thrust members hydraulically displaceable outwardly with respect to the body structure for engagement with the formation of the borehole being drilled; each actuator unit having an inlet passage for connection to a source of fluid under pressure and an outlet passage for communication with a lower pressure zone; selector valve means for connecting said inlet passages in succession to said source of fluid under pressure, as the unit rotates; choke means to create a pressure drop between the source of fluid under pressure and said selector valve means; and further choke means in the outlet passage from each actuator unit.

The invention further provides a modulated bias unit, for controlling the direction of drilling of a rotary drill bit when drilling holes in subsurface formations, comprising: a body structure; means for applying to the body structure a force having a lateral component at right angles to the axis of rotation of the body structure; means for modulating said lateral force component in synchronism with rotation of the body structure, and in selected phase relation thereto, whereby the maximum value of said lateral force component is applied to the body structure at a selected rotational orientation thereof, so as to cause the body structure to become displaced laterally as drilling continues; said means for applying the lateral force component to the body structure comprising means for supplying fluid under pressure to at least one opening in an outwardly facing surface of the body structure assembly; and said means for modulating said lateral force component comprising means for modulating the pressure of fluid delivered to said opening.

The invention also includes within its scope a drill bit for drilling boreholes in subsurface formations comprising a bit body having a shank for connection to a drill string, an inner passage for supply drilling fluid under pressure to the bit, and a plurality of cutting elements mounted on the bit body, the bit body including a modulated bias unit according to any of the other aspects of the invention.

BRIEF DESCRIPTION OF THE DRAWINGS

FIG. 15 is a diagrammatic longitudinal section through a still further form of PDC drill bit in accordance with the invention;

FIG. 16 is a side elevation of the lower part of the drill bit shown in FIG. 15;

FIG. 17 is a cross-section on the line 17—17 of FIG. 15;

FIG. 24 is a part horizontal section on the line 24—24 of FIG. 23;

FIGS. 25 to 28 are similar views to FIG. 24 of alternative forms of modulated bias unit in accordance with the invention;

DETAILED DESCRIPTION OF THE PREFERRED EMBODIMENTS

Figure 32:
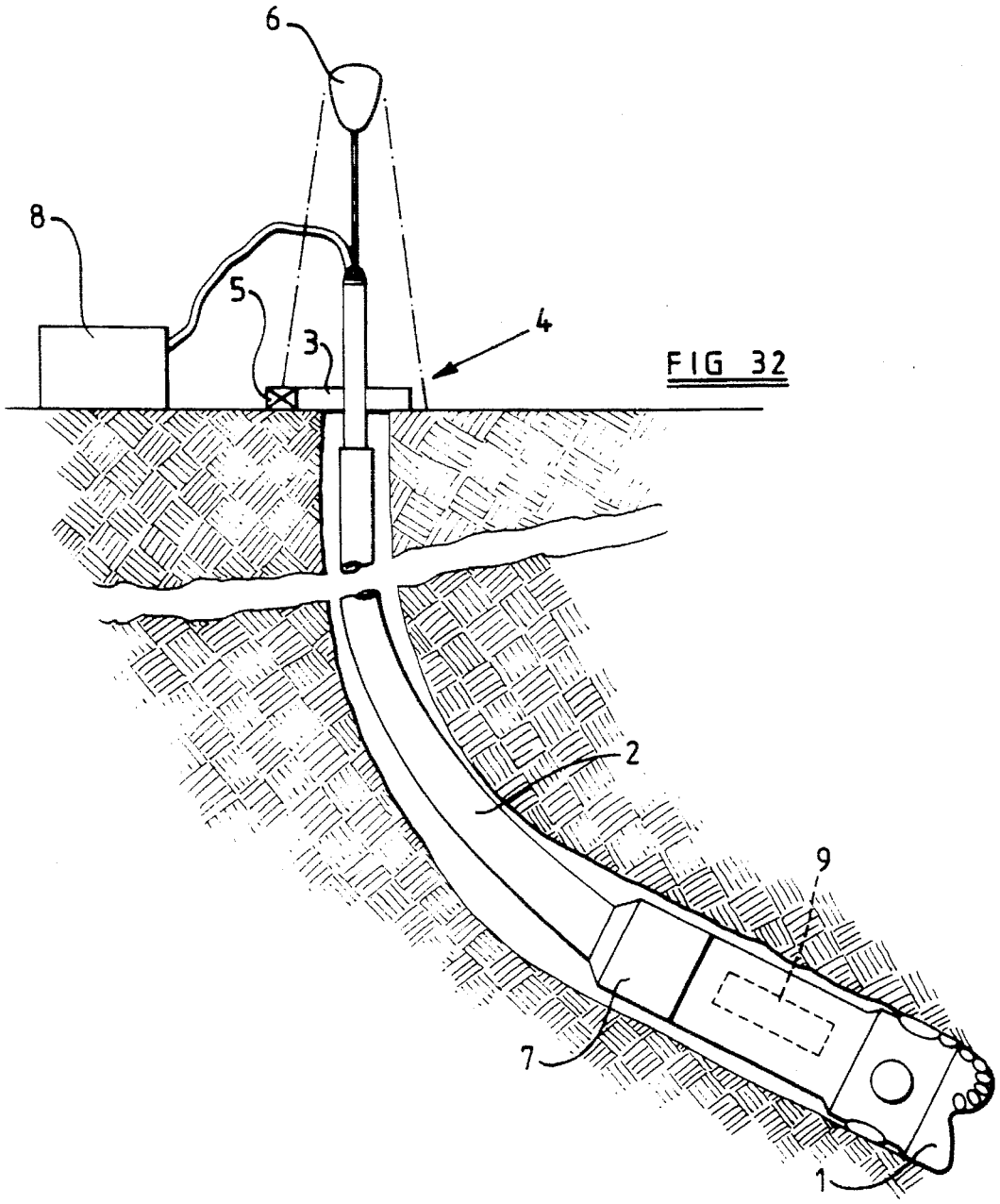
FIG. 32 is a diagrammatic sectional representation of a deep hole drilling installation of the kind in which systems according to the invention may be employed.

Reference will first be made to FIG. 32 which shows diagrammatically a typical rotary drilling installation of the kind in which the system according to the present invention may be employed.

As is well known, the bottomhole assembly includes a drill bit 1 which is connected to the lower end of a drill string 2 which is rotatably driven from the surface by a rotary table 3 on a drilling platform 4. The rotary table is driven by a drive motor indicated diagrammatically at 5 and raising and lowering of the drill string, and application of weight-on-bit, is under the control of draw works indicated diagrammatically at 6. A pumping station 8 delivers drilling fluid under pressure to the pipeline, such fluid passing downwardly within the drill string 2 and through the bottomhole assembly to emerge from nozzles in the drill bit to cool and clean the cutting elements on the bit before returning to the surface, carrying with it the cuttings created by the drilling operation, through the annulus between the drill string 2 and the surrounding wall of the borehole.

As is well known, the drilling fluid passing through the bottomhole assembly may also be used to provide power for operative functions required within the bottomhole assembly.

As previously explained, when the bottomhole assembly is a steerable system it is necessary for the system, while steering is taking place, to be continuously controlled by signals responsive to the instantaneous rotational orientation of the drill bit. The bottomhole assembly may include a roll stabilised system, indicated at 9, carrying an instrument package which supplies such continuous signals to the steering assembly and also to the MWD transmitter 7. The roll stabilised system may, for example, be of the kind described in British Patent Application No. 9213253.9.

In accordance with the present invention, the steering of the drill bit is effected by providing in the bottomhole assembly a synchronous modulated bias unit which applies a lateral bias to the drill bit during drilling, such lateral bias being modulated in synchronism with rotation of the drill bit so that the bias is applied in a constant direction in relation the borehole so as to cause deviation of the borehole as drilling proceeds. The modulated bias unit may be incorporated in the drill bit itself or may comprise a separate unit mounted above the drill bit in the bottomhole assembly. Various forms of modulated bias unit will now be described with reference to FIGS. 1 to 29 of the drawings.

Figure 1:
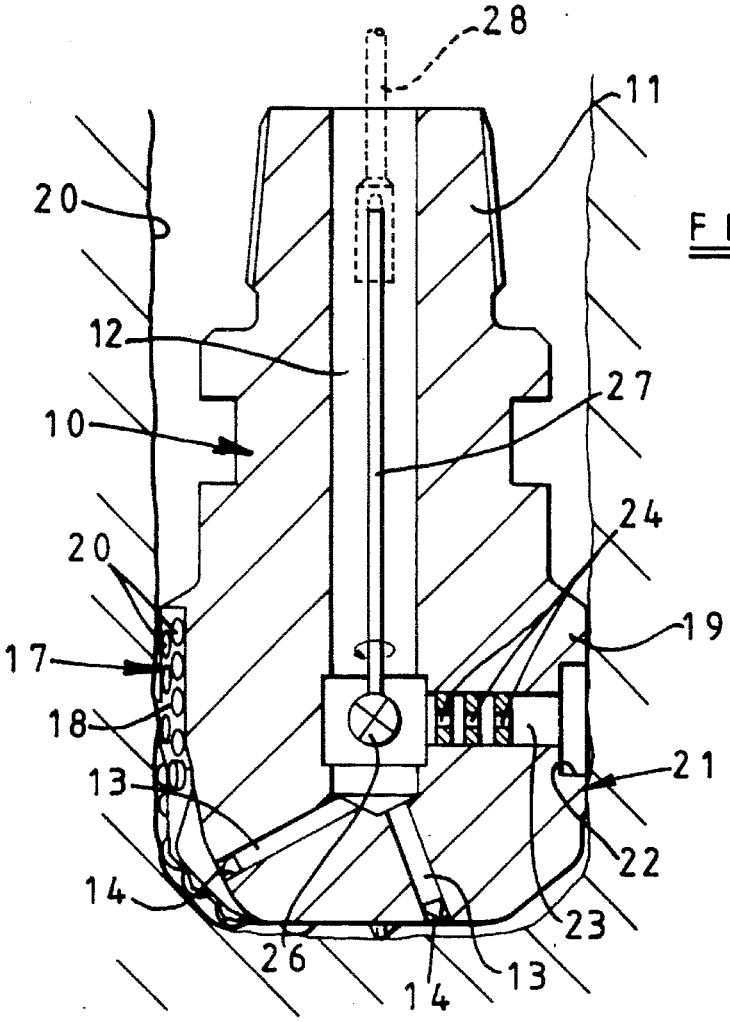
FIG. 1 is a diagrammatic longitudinal section through one form of PDC drill bit, shown downhole, incorporating one form of modulated bias unit in accordance with the invention.
Figure 2:
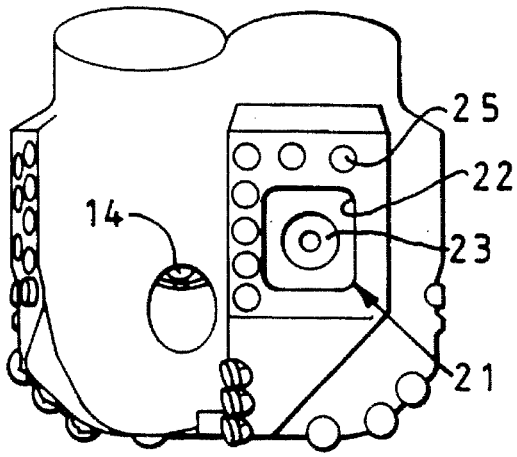
FIG. 2 is a side elevation of the lower part of the drill bit of FIG. 1.
Figure 3:
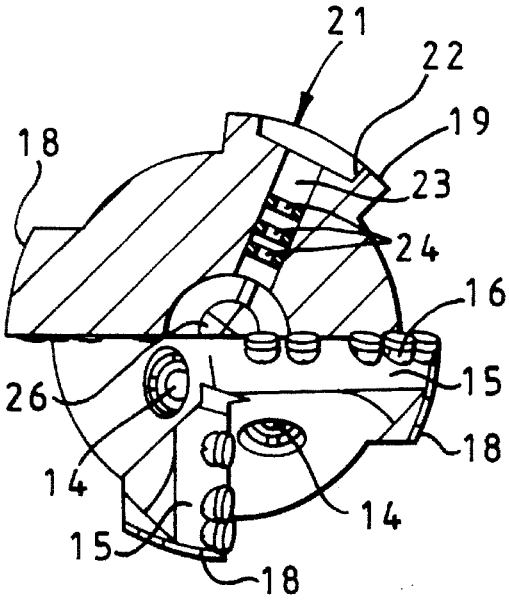
FIG. 3 is a part end view, part cross-section of the drill bit.

Referring to FIGS. 1–3, there is shown a rotary drill bit comprising a bit body 10 having a threaded pin 11 for connection to a drill string (not shown) and a central passage 12 for supplying drilling fluid through bores 13 to nozzles 14 in the face of the bit.

The face of the bit is formed with a number of blades 15, in this case four blades, each of which carries, spaced apart along its length, a plurality of PDC cutters 16. Each cutter may be of the kind comprising a circular tablet, made up of a superhard table of polycrystalline diamond, providing the front cutting face, bonded to a substrate of cemented tungsten carbide. Each cutting element is brazed to a tungsten carbide post or stud which is received within a socket in the blade 15 on the bit body.

The gauge portion 17 of the bit body is formed, in known manner, with four circumferentially spaced kickers 18, 19 which engage the walls 20 of the borehole being drilled and are separated by junk slots. Three of the kickers, indicated at 18, are of conventional form. For example, there are received in sockets in the kickers abrasion-resistant elements 20 comprising studs of cemented tungsten carbide some of which may be surface set with particles of natural or synthetic diamond.

However, one of the kickers 19 incorporates an hydrostatic bearing pad as indicated at 21. The bearing pad comprises a shallow cavity 22 which communicates with the central passage 12 of the drill bit by means of a conduit 23 formed with a series of chokes 24. The provision of a series of chokes allows greater internal diameter of the conduit, to prevent blockage, for a required pressure drop. Other forms of restrictors could also be used. As may be seen from FIG. 2, the cavity 22 may be partly surrounded by abrasion-resistant elements 25 similar to the elements 20 on the other kickers.

The supply of drilling fluid under pressure to the conduits 13 and 23 is controlled by a valve indicated diagrammatically at 26. The valve 26, which is controlled by a control shaft 27, is so arranged as to provide a modulated flow of drilling fluid to the conduit 23 and hence to the hydrostatic bearing 21 and a continuous flow to the nozzles 14, as the bit rotates.

It will be appreciated that when drilling fluid is supplied Under pressure to the hydrostatic bearing pad 21, the reaction force between the bearing pad and the wall 20 of the borehole will apply to the drill bit a lateral force at right angles to the axis of rotation of the bit. By modulating this force in synchronism with rotation of the bit structure, by operation of the valve 26, the maximum value of the lateral force may be applied to the bit body at the same rotational position of the drill bit during each revolution thereof. As a result a periodical lateral force is applied to the drill bit in a constant direction as the bit rotates. The phase relation between the modulation of the fluid pressure and rotation of the bit determines the direction of this periodic force and thus determines the direction of deviation of the borehole as drilling proceeds.

Periodic operation of the valve 26, and its phase relation to rotation of the drill bit, may be controlled, for example, in the manner described in our patent application Ser. No. 911373.3 where an instrument package is mounted on a roll stabilised sensor platform, i.e. a downhole structure which does not rotate with the rest of the bottomhole assembly. Alternatively the instrument package may be "strapped down" and revolving with the bit.

In either case, the instrument package includes sensors which preferably comprise a three-axis accelerometer and three magnetometers, enabling inclination and azimuth to be derived downhole for comparison with command signals. A signal is generated to indicate the desired direction about the bit axis of the required deviation. The latter signal is compared with the instantaneous orientation of the bit about its axis. A control signal, dependent on the difference, is then derived which controls the modulation of the hydrostatic bearing by control of the valve 26. This signal represents a continuously increasing angle. A cosine of this angle is alternating and synchronised with the rotation of the drill string and bit. Its phase determines the direction about the bit axis of the deviation. The signal may be for example transmitted by the concentric shaft output of the roll stabilised platform of application Ser. No. 911373.3, such shaft being indicated diagrammatically as 28 in FIG. 1.

When the desired inclination and azimuth of the borehole have been achieved, the modulation of the supply of drilling fluid under pressure to the hydrostatic bearing is stopped. The modulation may be stopped with the valve 26 either in an open or closed position. Alternatively, the steering effect may be stopped by rendering the operation of the valve 26 asynchronous with rotation of the drill bit.

Other means may be adopted for appropriate modulation of the hydrostatic bearing. For example arrangements similar to those used in British Specification No. 2246151 for controlling modulation of the mud hammer may be employed in the present case.

Figure 4:
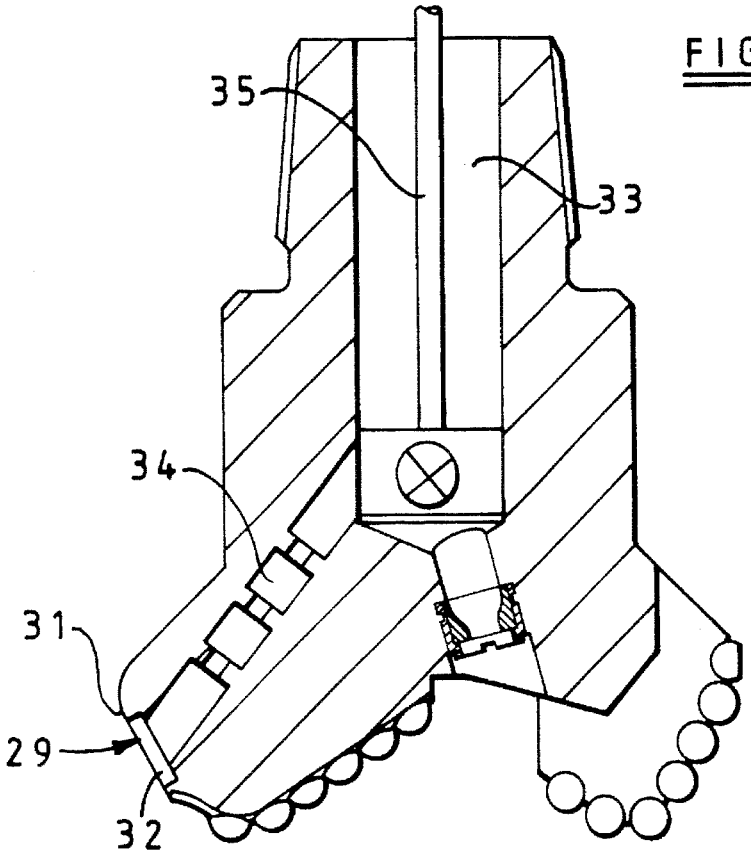
FIG. 4 is a diagrammatic longitudinal section through an alternative form of drill bit incorporating a modulated bias unit in accordance with the invention.
Figure 5:
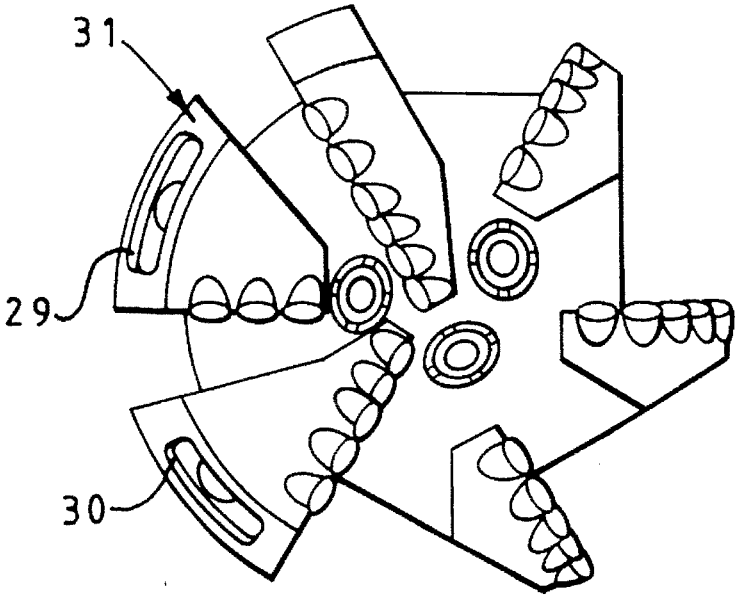
FIG. 5 is an end view of the bit shown in FIG. 4.

FIGS. 4 and 5 show diagrammatically an arrangement in which two hydrostatic bearing pads 29 and 30 are provided on a tapered part-conical portion 31 of an alternative form of drill bit. As in the previously described arrangement, each hydrostatic bearing comprises a cavity 32 which communicates with a central passage 33 through a conduit 34 formed with a series of chokes.

The reactive force between each hydrostatic bearing pad 29, 30 and the walls of the borehole has an upward axial component and a lateral component at right angles to the central axis 3S of the bit body. Since two hydrostatic bearings are provided, the total lateral force applied by the bearings to the drill bit is the resultant of these two lateral components. The supply of drilling fluid under pressure to both hydrostatic bearings is modulated in synchronism.

Although the means for applying a modulated lateral force component to the bit structure has been described as comprising one or more hydrostatic bearings, other force-applying arrangements may be provided instead. Although the force-applying arrangement may be incorporated in the drill bit structure itself, the invention includes within its scope arrangements where the force-applying assembly is incorporated in some other part of the bottom hole assembly.

The means for applying a lateral force component to the bit structure may comprise an hydraulic actuator including a member displaceably mounted on a part of the bottom hole assembly, for example on the drill bit itself, for engagement with the formation of the borehole being drilled, the member being displaceable inwardly and outwardly with respect to the axis of rotation of the bit structure. FIGS. 6–28 show examples of arrangements of this type.

Figure 6:
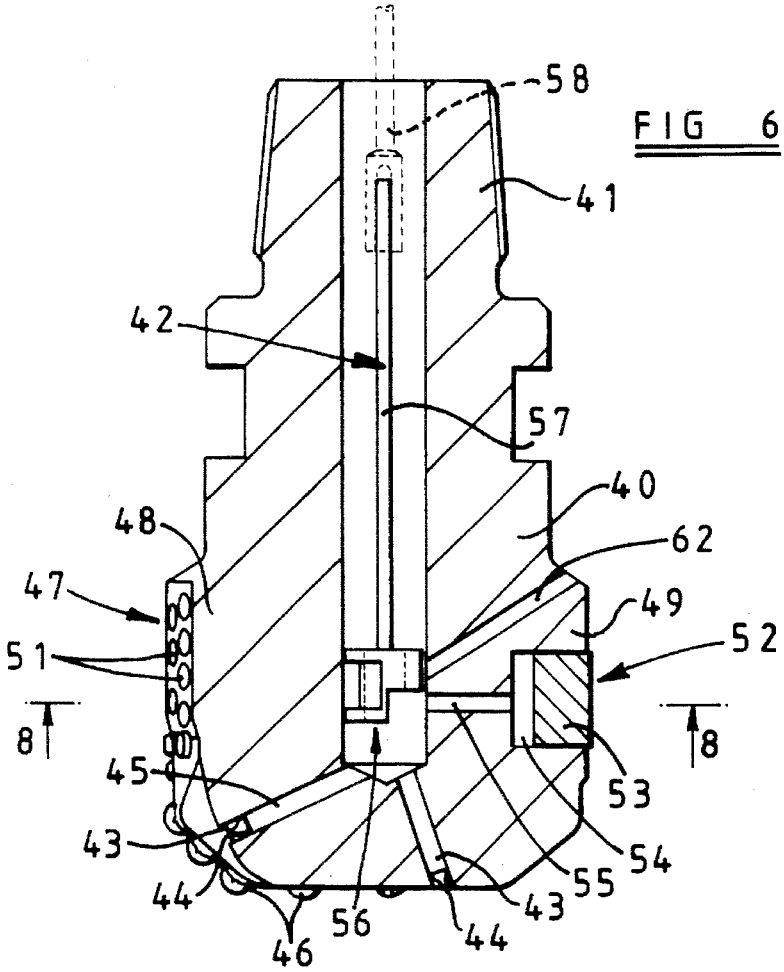
FIG. 6 is a diagrammatic longitudinal section through another form of PDC drill bit in accordance with the invention.
Figure 7:
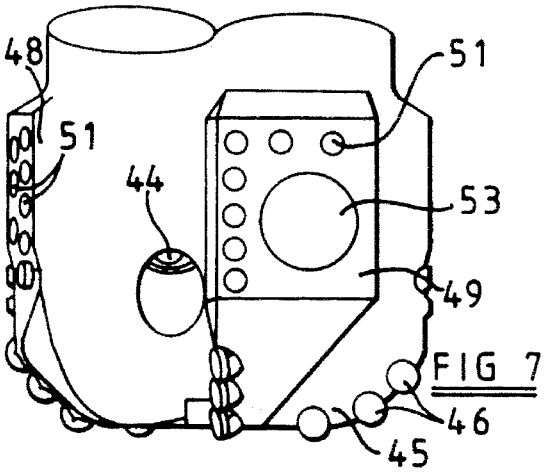
FIG. 7 is a side elevation of the lower part of the drill bit of FIG. 6.
Figure 8:
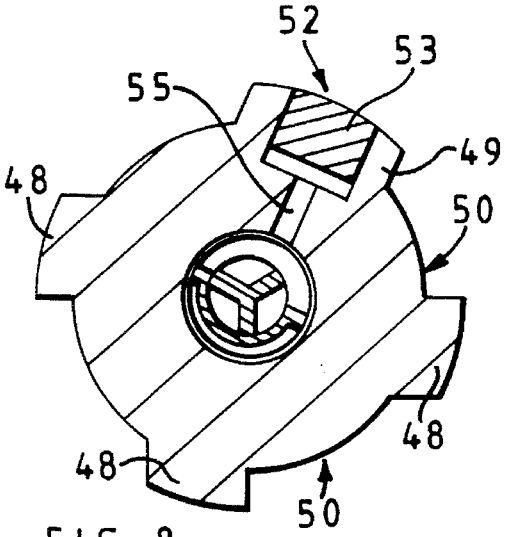
FIG. 8 is a cross-section on the line 8—8 of FIG. 6.

Referring to FIGS. 6–8, the rotary drill bit comprises a bit body 40 having a threaded pin 41 for connection to a drill string (not shown) and a central passage 42 for supplying drilling fluid through bores 43 to nozzles 44 in the face of the bit.

The face of the bit is formed with a number of blades 45, each of which carries, spaced apart along its length, a plurality of PDC cutters 46.

The gauge portion 47 is formed with four circumferentially spaced kickers 48, 49 which engage the walls of the borehole being drilled and are separated by junk slots 50. Three of the kickers, indicated at 48, are of conventional form and carry abrasion-resistant elements 51.

Figure 9:
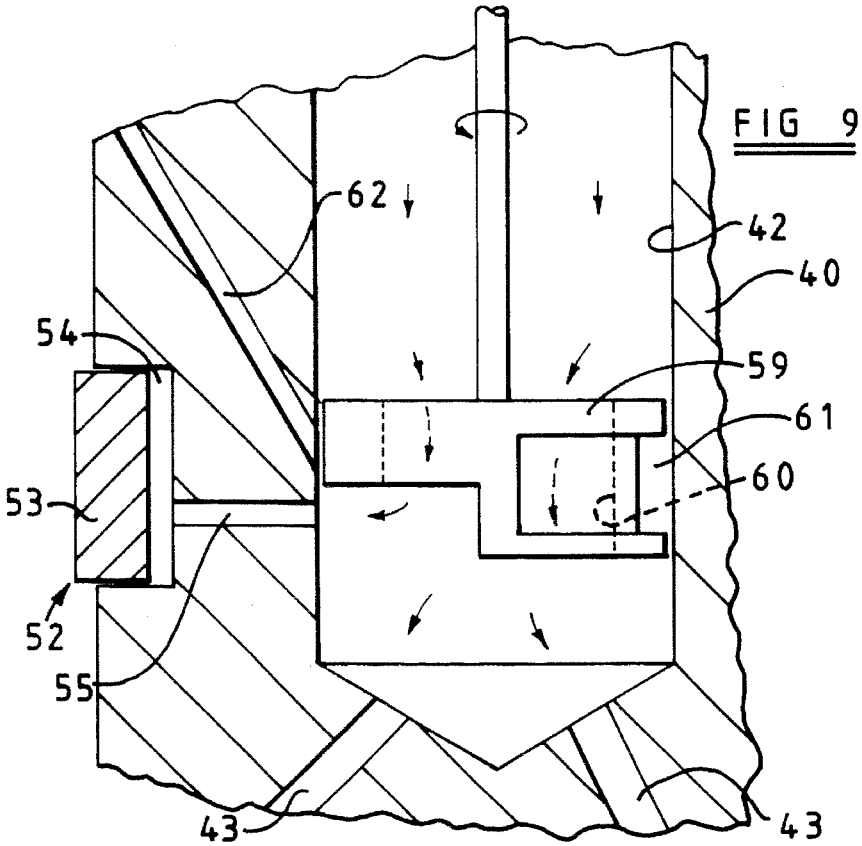
FIG. 9 is a diagrammatic section, on an enlarged scale, of the valve mechanism of the drill bit of FIGS. 6–8.

There is mounted in the bit body, and partly in one of the kickers 49, a piston assembly indicated generally at 52. The piston assembly, which is shown only diagrammatically in FIGS. 6 to 9, comprises a cylindrical piston 53 which is slideable in a matching cylindrical bore 54. The axis of the bore 54 extends radially with respect to the longitudinal axis of rotation of the bit and the bore opens into the outer surface of the kicker 49. A passage 55 places the bore 54 into communication with the central passage 42 of the drill bit and flow of drilling fluid along the passage 55 to the bore 54 is controlled by a valve 56. The valve 56, which will be described in greater detail in relation to FIG. 9, is controlled by a control shaft 57. The control shaft 57 may be connected to the concentric shaft output of the roll stabilised platform of the aforementioned British Patent Application No. 911373.3, such shaft being indicated diagrammatically as 58 in FIG. 6.

Referring to FIG. 9, the rotatable valve member 59 is formed with a central axial bore 60 through which passes the main flow of drilling fluid to the passages 43 leading to the nozzles in the face of the bit body. The valve member 59 is so shaped at its periphery that, during a portion of each relative revolution between the valve member 59 and bit body 40 the passage 55 leading to the bore 54 is placed in communication with the general flow of drilling fluid to the nozzles and the piston member 53 is therefore urged outwardly against the surface of the formation being drilled. However, during another part of the relative rotation an annular recess 61 around part of the periphery of the valve member 59 cuts the passage 55 off from communication with the main drilling fluid passage 42 and places it instead in communication with a bleed passage 62 leading to the annulus between the drill string and the formation above the bit body (as best seen in FIG. 6). This is a lower pressure zone so that the piston 53 retracts into the bore 54. Accordingly, the fluid pressure applied to the piston 53, and hence its displacement relatively to the bit body, is modulated upon relative rotation between the valve member 59 and bit body 40, in synchronism with such relative rotation and in selected phase relation to the bit rotation. As a result of the modulation of the displacement of the piston 53, a periodic lateral force is applied to the drill bit in a constant direction the bit rotates. The phase relation between the modulation of the displacement of the piston 53 and rotation of the bit determines the direction of this periodic force and thus determines the direction of deviation of the borehole as drilling proceeds.

As previously mentioned, the piston assembly 52, and also the valve 56, are shown only diagrammatically in FIGS. 6–9, and FIGS. 10–14 show in greater detail some more specific forms of piston arrangement. In each of the arrangements of FIGS. 10–14 the valve arrangement controlling flow of drilling fluid to and from the actuator is not shown, but may be similar to the arrangement shown in FIGS. 6–9 or FIG. 19.

Figure 10:
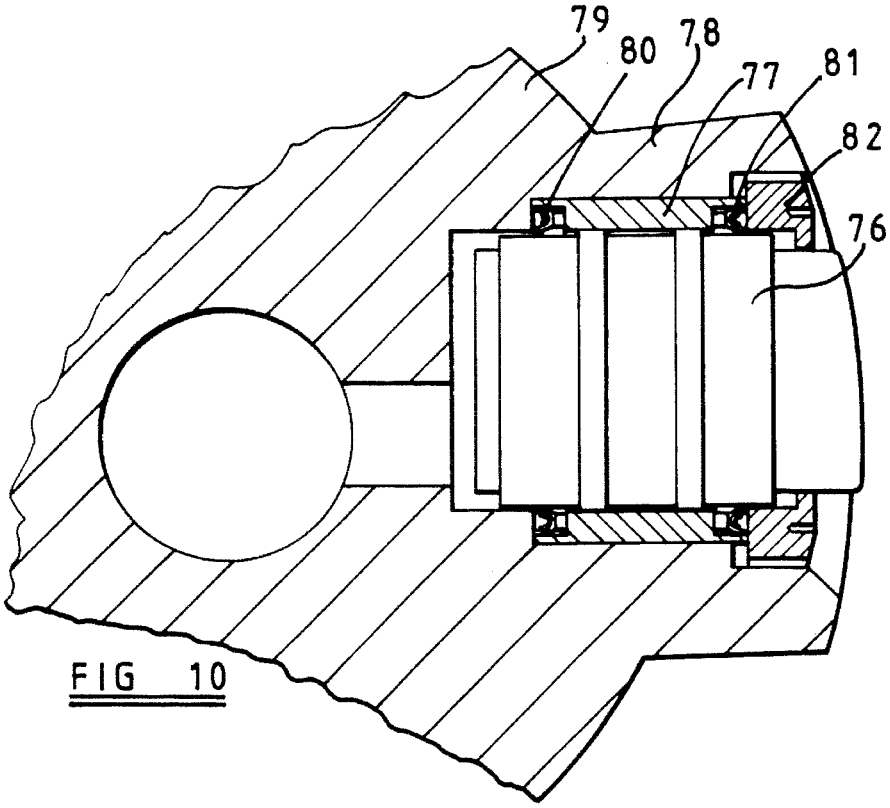
FIG. 10 is a part-sectional view of another form of drill bit in accordance with the invention, showing an alternative form of hydraulically displaceable member.

In the arrangement of FIG. 10 the actuator comprises a piston unit 76 which is slidable in a cylindrical insert 77 located in a cylindrical recess in one of the kickers 78 on bit body 79. Annular sliding seals 80 and 81 are provided between the insert 77 and the piston 76, and are arranged to protect the sliding surfaces from debris entrained in the drilling fluid. A further annular insert 82 is screwed into an enlarged outer portion of the recess in the kicker so as provide a stop to limit outward movement of the piston 76.

Figure 11:
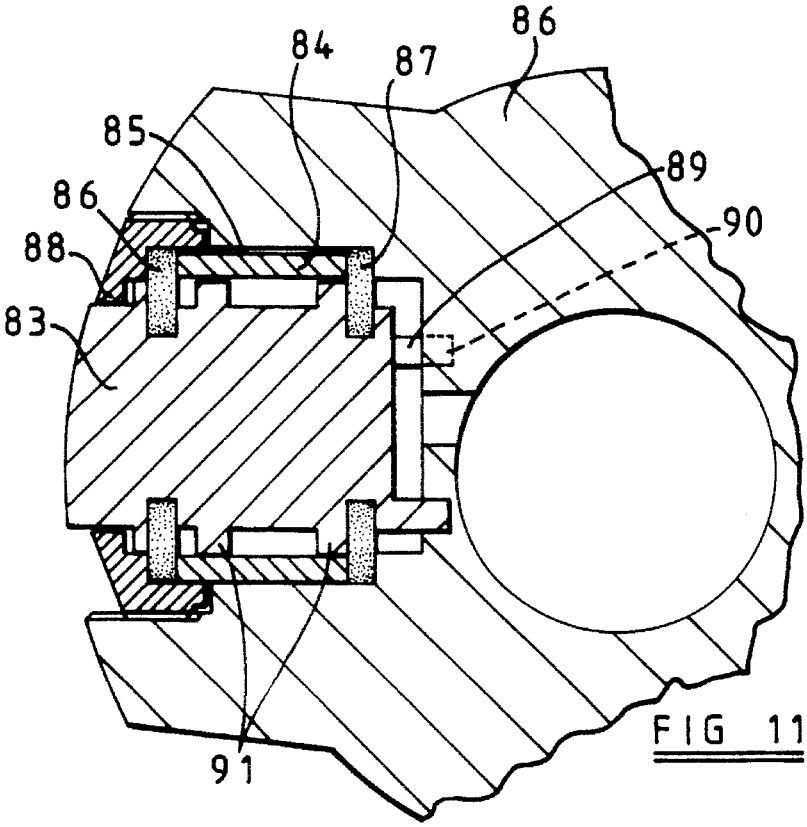
FIGS. 11–14 are similar views of further alternative constructions of displaceable member.

The arrangement of FIG. 11 similarly employs a sliding piston 83 as the actuator, which slides within a floating cylindrical insert spacer 84 in a cylindrical recess 88 in the bit body 86.

In this case annular rubber seals 86, 87 encircle piston 83 and are bonded securely thereto. The outer peripheries of the rubber seals 86, 87 are clamped between the bit body, the spacer 84 and a locking ring 88 which is screwed into the end of the cylindrical recess 85. An anti-rotation location pin 89 on the inner end of the piston 83 is slidable in a blind bore 90 in the bit body.

The piston 83 is formed with peripheral flanges, or part-flanges, 91 to assist in locating the piston within the cylindrical recess. The locking ring 88 also serves to limit the outward movement of piston.

Figure 12:
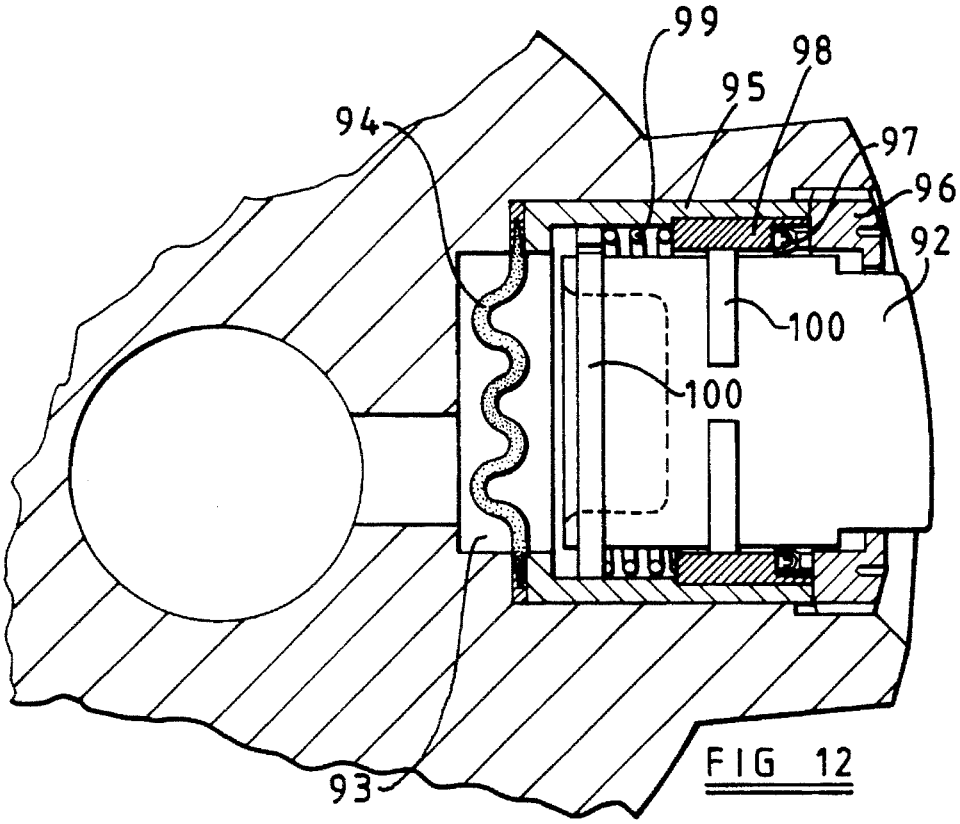

FIG. 12 shows an arrangement in which the inner end of the sliding piston 92 is sealed from drilling fluid delivered to the chamber 93 by a flexible diaphragm 94 which is clamped into position by a cylindrical sleeve 95 and locking ring 96. The locking ring 96 also serves to limit the outward movement of the piston 92. A resilient sliding seal 97 is provided between a bearing ring 98 and the piston 92 and a helical compression spring 99 is provided to bias the piston 92 inwardly. Peripheral flanges or part flanges 100 are provided on the piston 92 for sliding engagement with the surrounding elements 98, 99. The seal 97 and diaphragm 94 provide an enclosed chamber surrounding the major part of the piston 92, which chamber may therefore be filled with comparatively clean fluid which will not become contaminated by drilling fluid in use.

Figure 13:
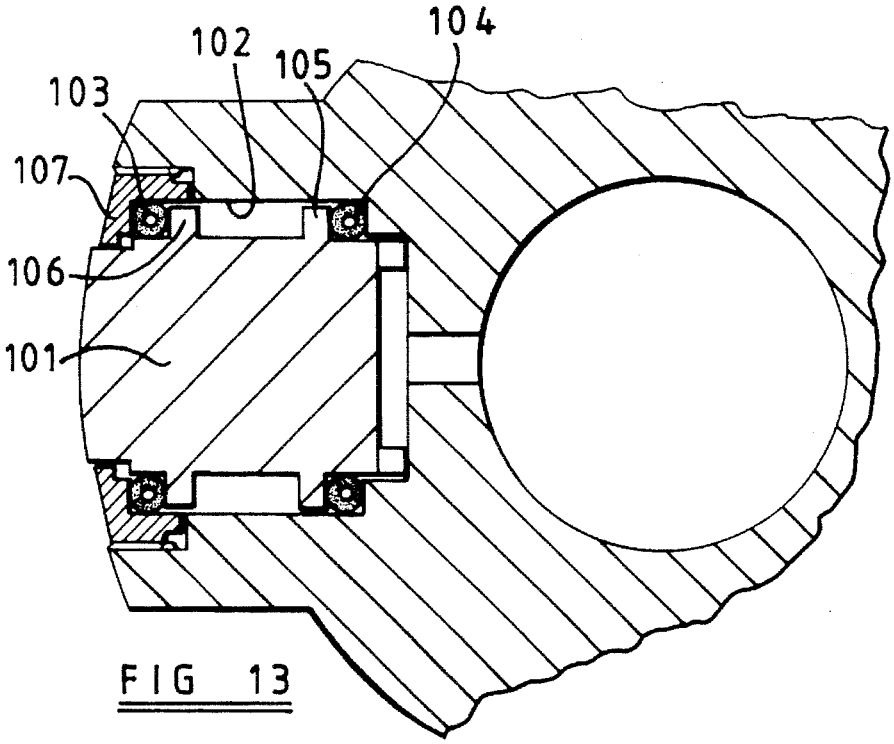

FIG. 13 shows a modified version of the arrangement of FIG. 11 in which the seals between the piston 101 and the surrounding cylindrical recess 102 are provided by compliant hollow annular rubber seals 103, 104. The inner seal 104 is compressed between a shoulder adjacent the bottom of the recess 102 and a peripheral flange 105 on the piston 101, whereas the outer seal 103 is compressed between a further flange 106 on the piston and an outer locking ring 107 this case the hollow annular rubber seals 103 and 104 provide both sealing between the piston 101 and the bit body and also allow, through their compression, for inward and outward travel of the piston.

Figure 14:
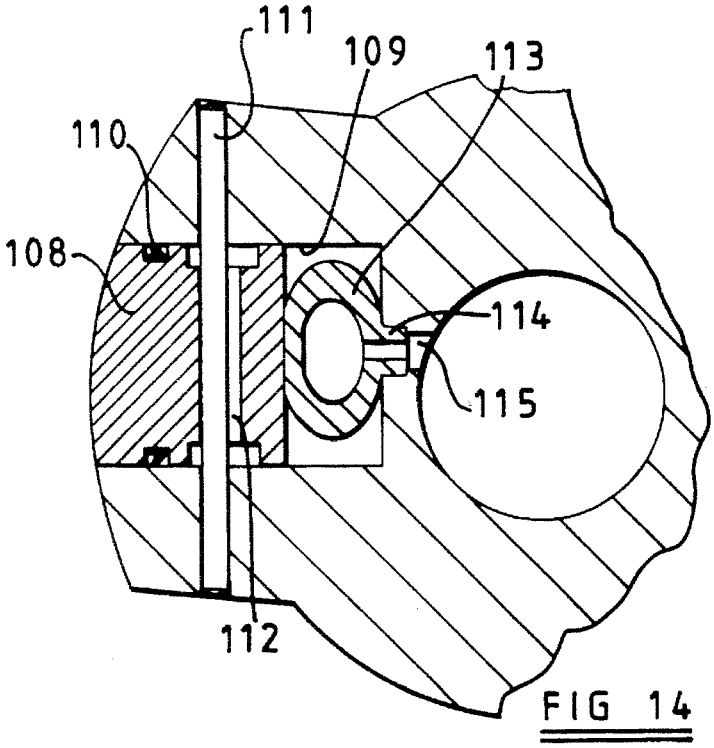

The arrangement of FIG. 14 employs a piston 108 which is slidable in a cylindrical recess 109 in the bit body, a peripheral seal 110 being provided around the piston. A transverse pin 111 extends through a transverse slot 112 of greater width in the piston 108 and serves both to prevent rotation of the piston 108 well as limiting its inward and outward travel.

In order to avoid the problems of sealing the periphery of the piston 108 adequately, outward pressure on the piston is provided by a closed flexible pressure bag 113 which is disposed between the inner end of the piston 108 and the bottom of the recess 109. An inlet/outlet neck 114 on the bag 113 is bonded within an inlet passage 115 in the bit body which communicates with the central bore of the bit via control valve or valves (not shown).

In each of the arrangements of FIGS. 10 to 14, it will be noted that the central axis of the piston element does not pass through the central axis of rotation of the bias unit. Instead it is parallel to a radius of the unit, but is displaced rearwardly of that radius with respect to the direction of rotation of the unit during drilling. (The rotation is normally clockwise as viewed from above.)

The reason for this is that the forces imposed on the piston by the formation during drilling comprise two major components: a normal component, which passes radially through the axis of rotation of the bias unit, and a tangential component due to friction. The resultant of these two components does not therefore pass through the axis of rotation of the unit, but is inclined rearwardly thereof. If the sliding axis of the piston were to lie along a radius of the unit, therefore, the tangential component would result in significant lateral forces between the piston and its recess, causing increased frictional opposition to the motion of the piston, and perhaps also rapid wear. By displacing the axis of the piston rearwardly, as shown, such lateral forces are reduced.

FIGS. 15–19 show an arrangement which is generally similar, in principle, to the arrangement of FIGS. 6–8 but comprises a different form of valve assembly 63. Otherwise, parts corresponding to parts of the arrangement of FIGS. 6–8 have the same reference numerals.

In this case, however, the valve assembly 63 comprises a fixed four-armed spider 64 mounted within the main passage 42 for drilling fluid, so as to permit the flow of drilling fluid past the valve assembly to the passages 43 and nozzles 44. Within the central boss 65 of the spider is a fixed valve assembly defining a chamber 66 which communicates through a passage 67 with the passage 55 leading to the bore 54 in which the piston 53 is slideable. The chamber 66 also communicates, through a passage 68, with a further passage 69 leading to the aforementioned passage 62 connected to the annulus. A further passage 70 leads from the chamber 66 to a position upstream of the valve assembly within the main passage 42 and a filter assembly (indicated diagrammatically at 71) is provided to prevent debris entering the passage 70.

Flow through the passages 68 and 70 is controlled by a rotatable valve disc 72 mounted on the end of the control shaft 57 and provided with an arcuate aperture 73. The inter-engaging sealing faces between the rotor 72 and the fixed part of the valve may be faced with polycrystalline diamond to reduce wear to a minimum.

Figure 18:
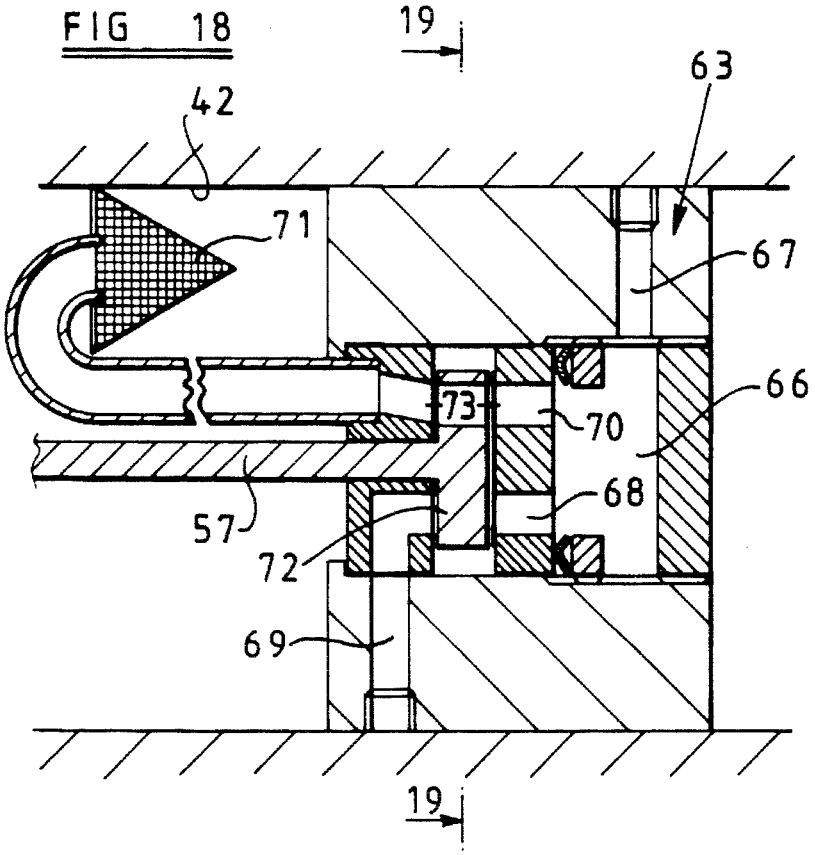
FIG. 18 is a diagrammatic longitudinal section, on an enlarged scale, through the valve mechanism of the construction of FIG. 15.
Figure 19:
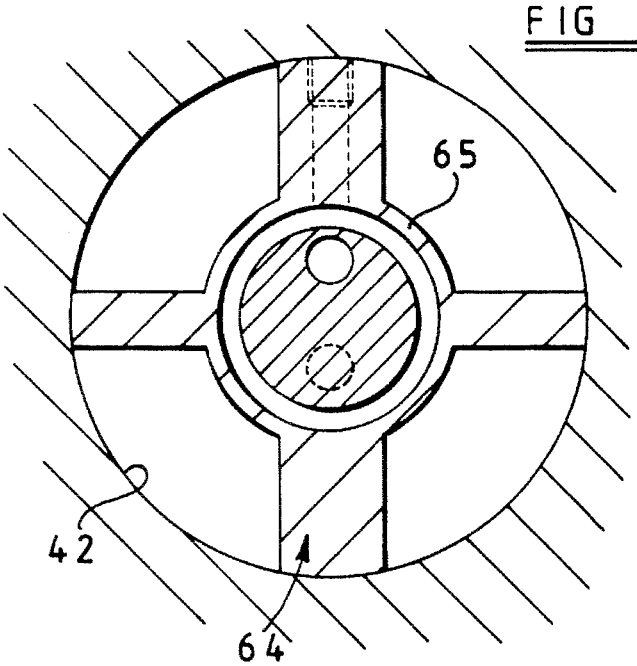
FIG. 19 is a horizontal cross-section through the valve mechanism.

When the valve disc 72 is in the position shown in FIG. 18, high pressure drilling fluid is communicated through the passage 70 to the chamber 66, passages 67 and 55 and hence to the bore 54, thus extending the piston 53. When the disc 72 is in the diametrically opposite position it shuts off flow through the passage 70 and opens up the passage 68 so that the chamber 66, and hence the bore 54, is in communication with the lower pressure in the annulus, through the passages 69 and 62. The piston 53 therefore retracts.

As in the previously described arrangement the relative rotation between the valve and the bit body modulates the fluid pressure in the bore 54, and hence modulates the displacement of the piston 53, in selected phase relation to rotation of the drill bit, so as effect deviation of the direction of drilling in a selected direction.

The angular extent of the aperture 73 in the disc 72 (and similarly the angular extent of the annular recess 61 in the arrangement of FIG. 9) is selected according to what angular extent the drill bit is required to rotate through with the piston displaced outwardly. For example, the angular extent of the aperture or recess may be approximately 180°, so that the piston is displaced outwardly for approximately half of each revolution of the drill bit and is retracted inwardly for the other half revolution.

The arrangements described above in relation to FIGS. 1 to 19 have all been described as single phase systems in which the bias unit comprises only a single actuator operated in synchronism with rotation of the drill bit. Such system is particularly suitable for use with anti-whirl bits where the bit is so designed as to have an inherent lateral bias during normal drilling for the purposes of minimising the tendency for bit whirl to be induced. However, in the case of regular drill bits where, during normal drilling, there is not intended to be any significant inherent lateral bias, the sensitivity of a single phase system may be impaired by the gauge section of the bit on the side opposite the actuator. For this reason polyphase systems may be preferred in which two or more actuators are symmetrically disposed around the periphery of the bit, or around the periphery of the bias unit in the case where it is separate from the bit, so that different parts of the gauge of the bit are biased against the formation as the bit rotates while steering.

Figure 20:
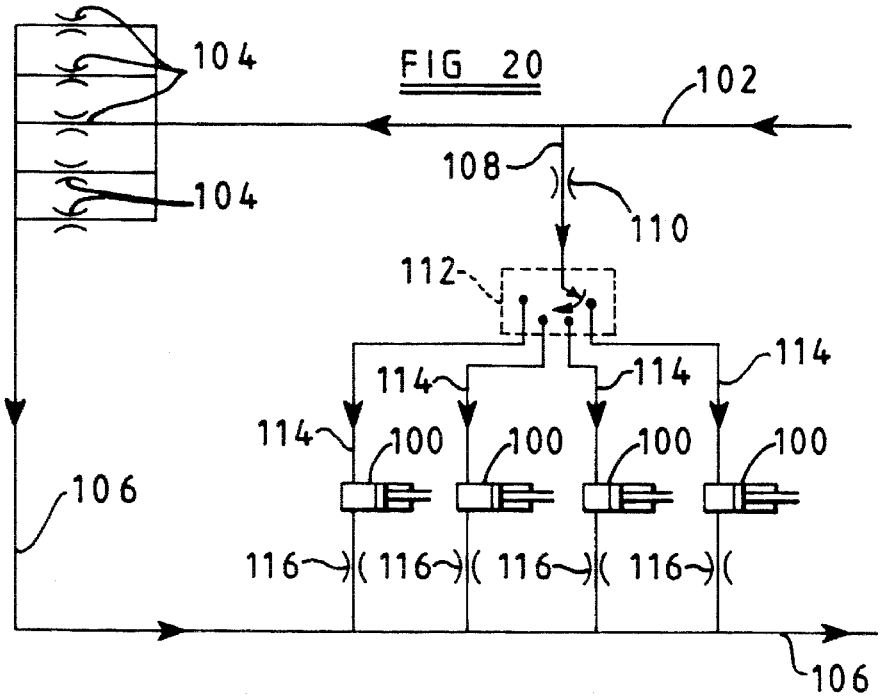
FIG. 20 is an hydraulic circuit diagram showing one form of polyphase modulated bias system in accordance with the invention.
Figure 21:
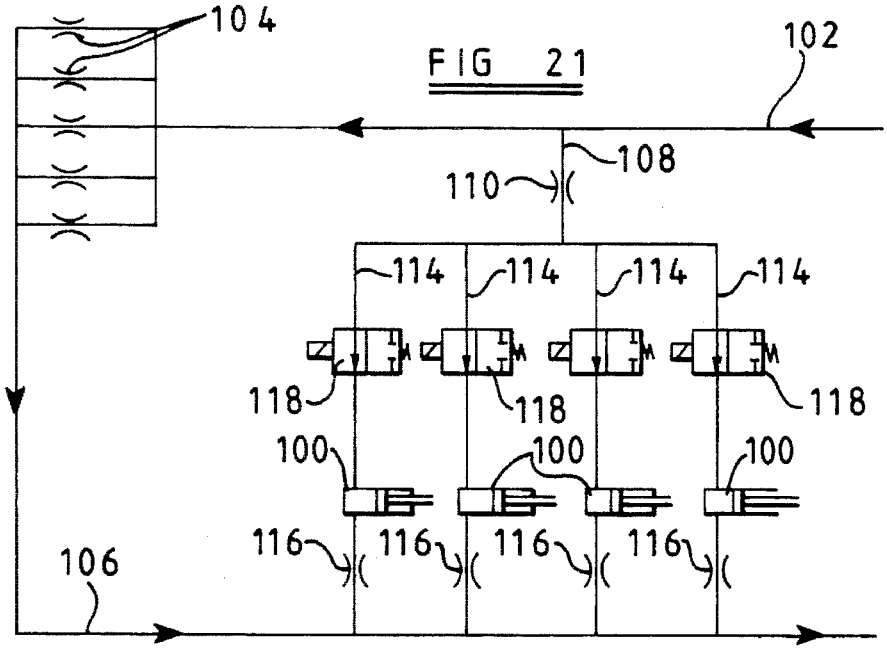
FIGS. 21 and 22 are further hydraulic circuit diagrams showing alternative operating systems for a polyphase arrangement.
Figure 22:
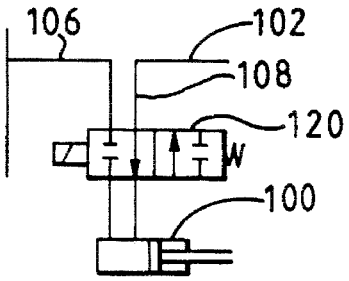

FIGS. 20 to 22 show diagrammatically alternative forms of hydraulic circuit for operation of such a system. FIG. 20 shows a typical circuit diagram for an attenuated parallel hydraulic system.

Referring to FIG. 20, there are provided four hydraulic actuators 100 spaced symmetrically apart around the periphery of the drill bit or associated bias unit. Such actuators may be of any of the kinds previously described for use in the single phase systems of FIGS. 1 to 19, or of any of the kinds to be described in relation to FIGS. 23 to 28.

FIG. 20 indicates at 102 the flow of drilling fluid downwardly along the drill string. The flow of drilling fluid is supplied in parallel to a plurality of nozzles 104 in the drill bit, the drilling fluid emerging under pressure from the nozzles and serving, in well known manner, to clean and cool the cutting elements on the drill bit and to entrain the cuttings produced by the drilling operation and return them to the surface in the flow, indicated at 106, upwardly through the annulus between the drill pipe and the surrounding wall of the borehole.

In the arrangement of FIG. 20 the actuators 100 are arranged in parallel with the nozzles 104 and drilling fluid under pressure is delivered from the flow 102 as indicated at 108. The flow 108 to the actuators is attenuated by a primary choke 110 before passing to a four-way distributing valve 112, which may be a disc valve as will be described. The choke 110 may be selected, at the drilling site, to reduce the high pressure at 102 to an appropriate workable pressure at the valve 112.

The four-way valve 112 distributes the flow 108 sequentially between the four actuators 100 as indicated at 114. A secondary choke 116 is located in the flow between each actuator 100 and the flow 106 upwardly along the annulus.

The valve 112 is operated in synchronism with rotation of the drill bit so that the actuators 100 are successively actuated, usually once during each rotation.

FIG. 21 shows an alternative attenuated parallel system in which the four-way valve 112 is replaced by four separate on/off valves 118 disposed in the flow 114 to each respective actuator 100. The individual valves 118 are operated sequentially in synchronism with rotation of the drill bit. For example, they may be electrically operated valves, such as solenoid valves, operated by a sequential electric switching mechanism which operates synchronously with rotation of the drill bit.

In the arrangements of FIGS. 20 and 21 the valve mechanisms are shown as being located upstream of the actuators, with the chokes being located downstream. However, this arrangement may be reversed, with the chokes being located upstream of the actuators and the valves, whether a single selector valve or individual valves, being located downstream. Arrangements of the latter kind are described below with reference to FIG. 27 and FIGS. 30 and 31.

Also the individual chokes might also be replaced by valves, so that a control valve is located both upstream and downstream of each actuator. Such an arrangement is shown in FIG. 22 where each actuator is 100 (only one such actuator being shown in FIG. 22) controlled by a two-way valve 120 which controls the flow both upstream and downstream of the actuator. In one position, shown in FIG. 22, the actuator 100 is placed by the valve 120 in communication with the flow 108 from the central bore of the drill string, and cuts off communication of the actuator from the annulus flow 106 so that the actuator then operates. When operation of the actuator is to cease the valve 120 is operated (electrically or mechanically) to cut off the actuator from the supply 108 and to place it into communication with the annulus flow 106.

When the actuators are referred to herein as being operated successively by their associated control valves, this should not be taken to mean that the operation of one actuator is completed before the operation of the next is begun. It means only that the operations are initiated successively. Thus the valves controlling the operation of two adjacent actuators will be directing fluid pressure to both actuators over a significant part of each rotation of the bias unit.

Figure 23:
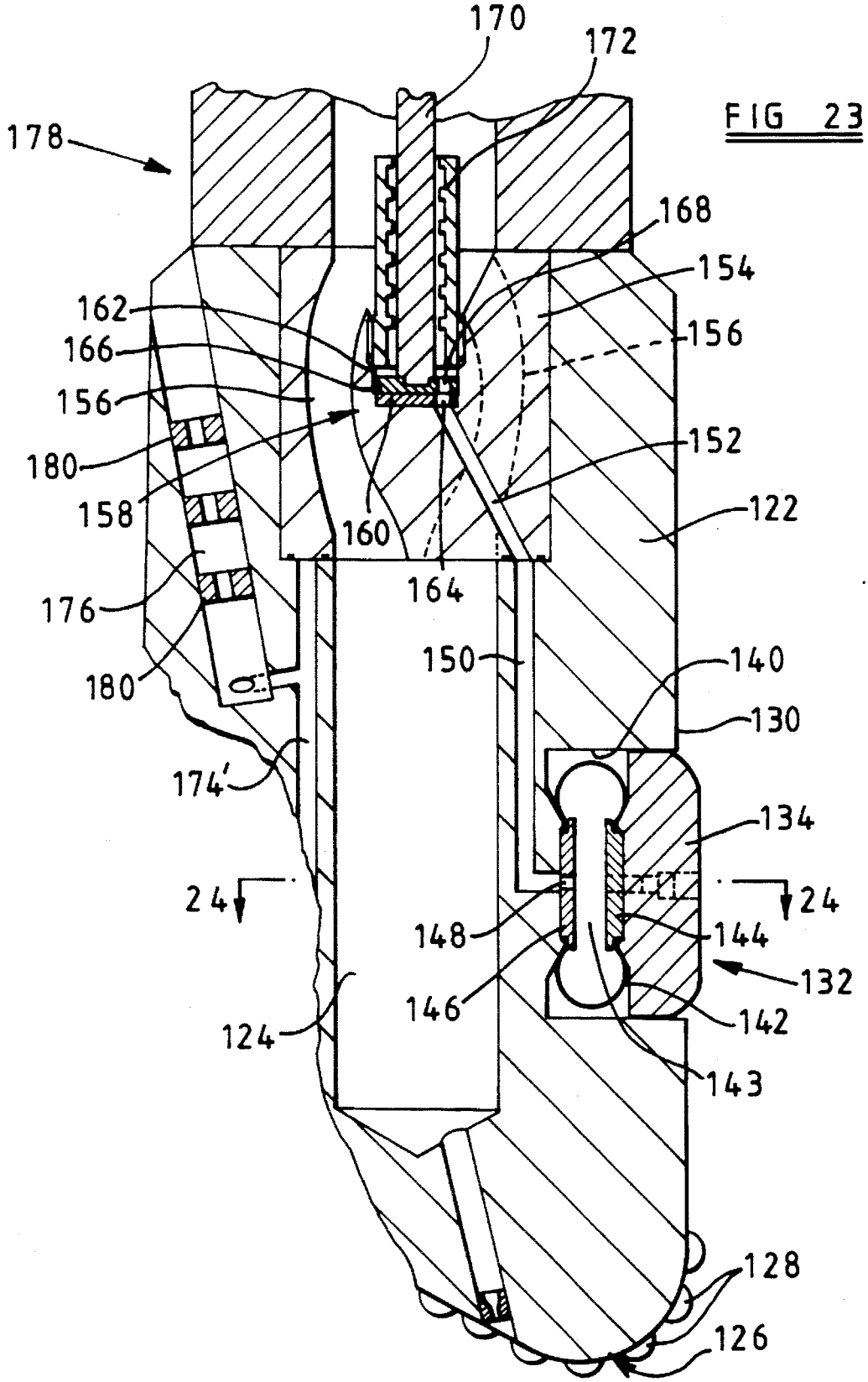
FIG. 23 shows part of a diagrammatic longitudinal section, in two planes, through a PDC drill bit showing a preferred form of polyphase modulated bias unit.

FIGS. 23 and 24 show in greater detail a preferred form of polyphase modulated bias unit operating under the attenuated parallel hydraulic system shown in FIG. 20.

Referring to FIGS. 23 and 24, the bit body 122 includes a central bore 124 through which drilling fluid under pressure is delivered to nozzles, not shown, in the end face 126 of the bit. Fluid emerging from the nozzles serves to clean and cool the cutting elements 128 and to convey cuttings upwardly to the surface through the annulus between the drill string and the surrounding wall of the borehole being drilled.

Spaced apart equally around the gauge portion 130 of the bit body are four bias actuators 132. The movable part of each actuator comprises a paddle 134 one end of which is pivotally connected to the bit body 122 by a pivotal mounting 136, the axis of which is parallel to the central longitudinal axis of the drill bit. An abutment surface 338 on the bit body adjacent 134 the pivot 136 co-operates with faces on the paddle to limit the inward and cutward pivoting movement of the paddle.

An inner part of the paddle 134 is pivotable into and out of a recess 340 in the bit body. Located within the recess 140 is a part-toroidal seal 142 the outer face of which is sealingly clamped to the inner surface of the paddle 134 by a disc 144, and the inner face of the toroidal seal 142 is clamped to the inner surface of the recess 140 by a further disc 146 formed with two spaced apertures 148 and 149.

An inlet passage 150 formed in the bit body leads to the hole 148 and places the interior of the seal 142 into communication with a further passage 152 in a cylindrical valve carrier block 154 mounted across the central bore 124 of the bit body. The valve carrier 154 is formed with a number of bypass passages 156 which allow the flow of drilling fluid past the valve carrier 154 and to the lower part of the central bore 124 from where the fluid is delivered to the nozzles.

The valve carrier 154 supports a valve assembly 158. The assembly comprises a bearing disc 160 mounted in the bottom of a cylindrical recess 162 in the valve carrier and formed with four valve apertures 164. Only one of the apertures 164 is shown in FIG. 23 registering with the inlet passage 152 leading to the actuator 132. However, the disc 160 is formed with four apertures each of which registers with the inlet passage of a different one of the four actuators provided around the periphery of the drill bit.

Rotatable over the disc 160 is a valve disc 166 which is formed with a single aperture 168 and is secured to the lower end of a control shaft 170. The aperture 168 is circumferentially elongate so that it may overlap more than one of the apertures 164 at a time. The control shaft 170 passes through an elongate labyrinth choke 172, the lower end of which is screw threaded into the upper part of the recess 162 in the valve carrier. The engaging surfaces of the discs 160 and 166 are preferably diamond faced.

The labyrinth choke 172 corresponds to the primary choke 110 in FIG. 20, and may be selected according to the pressure requirements at the drilling site. By passing the control shaft through the labyrinth choke 172 itself, the necessity of passing the shaft through a contacting rotary pressure seal is avoided. This eliminates the extra torque requirement which would result from the friction applied by such a contact seal.

The control shaft 170 may comprise the output shaft of a roll stabilised system of any of the kinds referred to in British Patent Application No. 9213253.9. The roll stabilised system causes the shaft 170 to remain stationary in space as the drill bit rotates and consequently the four apertures 164 and inlet passages 152 are brought successively opposite the aperture 168 once during each revolution of the drill bit. Thus, the actuators 132 are successively brought into communication with the drilling fluid pressure, attenuated by the labyrinth choke 172.

When the aperture 168 begins to overlap the aperture 164 associated with a particular actuator 132, the interior of the toroidal seal 142 of that actuator is placed in communication with the attenuated drilling fluid pressure by means of the inlet passages 150 and 152, and the increase in pressure within the cavity 143 enclosed by the seal 142 and the plates 144 and 146 increases the volume of the cavity and urges the paddle 134 outwardly against the wall of the surrounding formation and thus biases the drill bit in the opposite direction since the actuators 132 are actuated successively, each being actuated once during each revolution of the drill bit the resulting bias to the drill bit is always in the same lateral direction. This direction depends on the rotational orientation of the shaft 170 and disc 166 in space. Thus the direction of displacement of the drill bit during drilling, and hence consequent deviation of the borehole, may be determined by appropriate selection of the rotational position of the control shaft 170.

As the drill bit rotates from the position where the aperture 168 is in communication with the aperture 164 of a particular actuator, the paddle 134 of that actuator begins to be urged towards its recess 14 by the pressure of the formation, and the drilling fluid within the cavity 143 is exhausted to the annulus between the bit body and the surrounding formation. This is achieved by a further passage 174 in the bit body which leads from the hole 149 opening into the recess 140 and is generally parallel to the inlet passage 150. The exhaust passage 174 of the actuator 132 shown in FIGS. 23 and 24 may be seen in FIG. 24, but is not shown in FIG. 23. However, FIG. 23 shows the corresponding exhaust passage 174' which leads from the similar actuator (not shown) which is located diametrically opposite the actuator 132 on the drill bit. Each exhaust passage 174 or 174' communicates with a larger angled passage 176 in the bit body which leads upwardly and outwardly to the annulus 178, each passage 176 being formed with a plurality of longitudinally spaced chokes 180. The size of the chokes 180 is selected to cause sufficient pressure to build up in the cavity 143 when the valve is switched to that cavity, while allowing the pressure to dissipate sufficiently rapidly subsequently.

In known manner the gauge portion of the drill bit will normally be provided with abrasion-resistant elements. Such elements may also be mounted in the outer formation-engaging surface of each paddle 134, as indicated at 182 in FIG. 24.

Although the disc valve assembly 158 is preferably operated by the control shaft of a roll stabilised system as disclosed in British Specification No. 921353.9, it will be appreciated that other means may be provided for operating the valve in synchronism with rotation of the drill bit. For example the valve may be operated by an electric motor or other servo mechanism controlled by signals from an appropriate instrument package. Furthermore, the disc valve assembly 158 is shown by way of example only, and it will be appreciated that other forms of hydraulic switching valve mechanism may be employed.

FIGS. 25–29 show other forms of bias actuator. In each case the valve arrangement controlling the flow of drilling fluid to and from the actuator is not shown but may be of any of the kinds described herein in relation to other embodiments of the invention.

FIG. 25 is a similar view to FIG. 24 showing an alternative form of bias actuator. Again, four such actuators will be provided spaced equally apart around the periphery of the drill bit or separate bias unit.

The actuator 182 of FIG. 25 comprises again a paddle 184 pivotally mounted at 186 on the bit body and projecting partly into a recess 188 formed in the bit body. In this case, however, the inner end of an inward projection 190 on the paddle 184 is connected to the bit body by a fabric-reinforced elastomeric annular rolling diaphragm 192. The inner periphery of the diaphragm 192 is clamped to the inner surface of the extension 190 by a plate 194 and the outer periphery is clamped to the bit body by clamping rings 196 in the recess 188. An enclosed cavity 198 is thus formed between the diaphragm 192 and the bottom of the recess 188 and an inlet port 200 leads into this cavity and is connected by passages (not shown) to the control valve assembly which may be of the kind indicated at 158 in FIG. 23 or of any other appropriate kind. An exhaust port 202 leads from the cavity 198 and communicates with the annulus via an exhaust choke similar to the choked passage 176 of FIG. 23.

As is well known, a rolling diaphragm has an annular portion which is generally of elongate U-shape in cross-section and extends between the surfaces of the relatively movable parts, as shown in FIG. 25, so as to permit a substantial degree of relative movement between the parts, i.e. the paddle 184 and the bit body, without imposing undue strain on the diaphragm.

FIG. 26 shows a further form of actuator 204, again in the form of a paddle 206 pivotally mounted at 208 on the bit body. In this case the movable seal between the paddle 206 and the bit body comprises a compression/shear seal 210.

The seal 210 is connected between a generally conical central support element 212 on the inner surface of the paddle 206 and a surrounding conical surface within an annular ring 214 in screw-threaded engagement with the peripheral wall of the recess 216 in the bit body.

The seal assembly 210 comprises a number of laminations of elastomer 218 bonded between rigid conical separation rings 220. The inner ends of the rings 220 are formed with projecting conical flanges 222 which serve as stops to limit the travel of each lamination relative to the adjacent one. Again the purpose of the seal assembly 210 is to permit inward and outward pivoting movement of the paddle 206 while forming a seal for the chamber 224 between the paddle and the bottom wall of the recess 216. An inlet passage 226 for drilling fluid leads into the chamber 224 and an outlet passage 228 leads to the annulus, as previously described.

Figure 27:
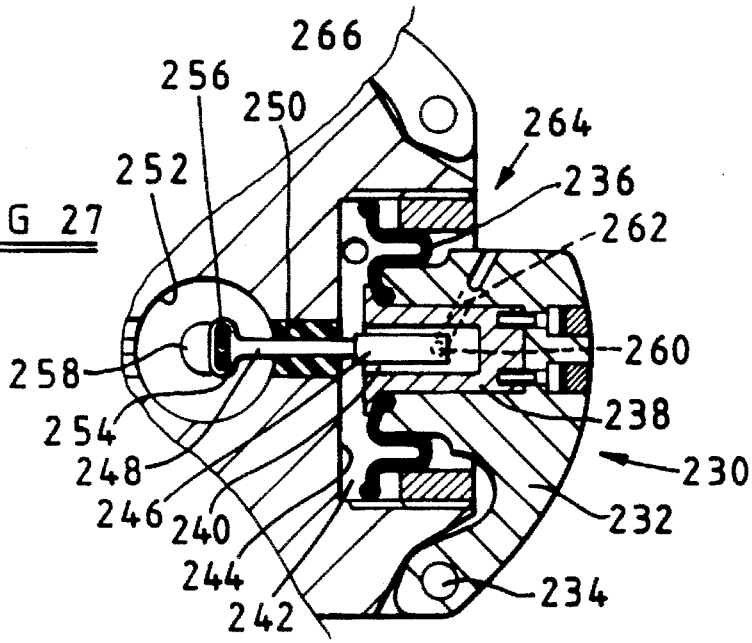

FIG. 27 illustrates a further alternative arrangement which is somewhat similar to the embodiment of FIG. 25 in that the actuator 230 comprises a paddle 232 which is pivotally mounted at 234 on the bit body and where the seal between the paddle and the bit body is provided by a rolling diaphragm 236. In this case, however, the motion of the paddle is made to follow the motion of a control element which is constrained to move sinusoidally.

In this case, the inner surface of the paddle 232 receives a generally cup-shaped insert 238 which provides an inwardly facing blind passage 240 communicating with the chamber 242 between the rolling diaphragm 236 and the bottom of the recess 244 in the bit body.

Slidable within the passage 240 is an elongate valve element 246 which is mounted on the end of a sliding shaft 248 which extends radially through a bearing 250 in the bit body and projects into the central bore 252.

The end of the shaft 248 is formed with a Scotch yoke mechanism comprising a transverse elongate slot 254 in which engages an eccentric pin 256 on a shaft 258 extending axially along the bore 252.

The outer end of the valve element 246 co-operates with an outlet aperture 260 in the wall of the passage 240 which outlet aperture communicates through a passage 262 with the annulus 264 between the bit body and the surrounding formation (not shown).

The shaft 258 is coupled to the control shaft of the roll stabilised assembly referred to previously and thus remains stationary in space as the bit rotates about it. Consequently, as the bit rotates the valve element 246 moves inwardly and outwardly sinusoidally as a result of being engaged by the eccentrically located pin 256. As the valve element 246 moves outwardly it closes the aperture 260. The chamber 242 behind the rolling diaphragm 236, which is in communication with the central bore of the drill bit via an inlet port 266, is pressurised causing the paddle 232 to move outwardly. Such movement continues until the aperture 260 has mowed clear of the end of the valve element 246 so that the interior of the chamber 242 is again vented to the annulus.

As the valve element 246 then moves inwardly again, the paddle 232 is urged inwardly, as a result of the external forces acting thereon, drilling fluid continuing to escape through the passage 262. When a position is reached where the aperture 260 is again covered by the valve element 246, the paddle 232 begins to move outwardly again.

The inward and outward movement of the paddle 232 therefore follows the inward and outward movement of the valve element 246 and is thus in synchronism with rotation of the drill bit.

The three other actuators on the drill bit are similarly arranged and all have valve element shafts corresponding to shaft 248 which are in engagement with the eccentric pin 256. The four valve elements corresponding to 246 are thus moved successively inwardly and outwardly during each rotation, with consequent successive inward and outward movement of the four paddles corresponding to paddle 232.

Figure 28:
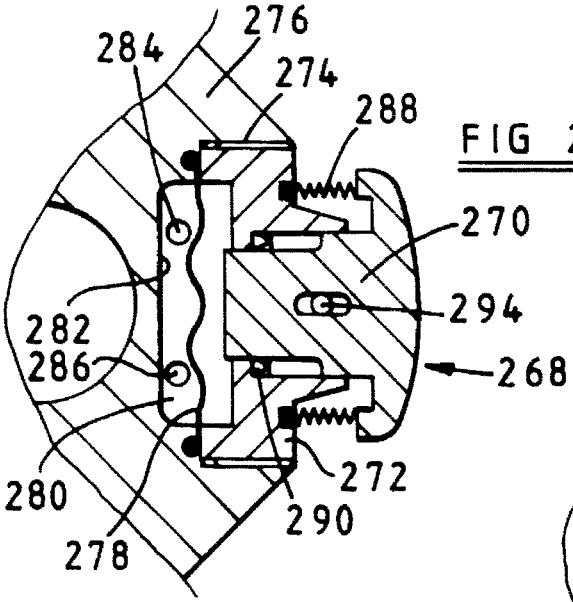

FIG. 28 shows a further alternative arrangement in which the actuator 268 comprises a slidable piston element 270 instead of a hingedly mounted paddle. In this case the piston element 270 is slidable within an annular cylinder element 272 which is screw-threaded into a recess 274 in the bit body 276. A diaphragm 278 is clamped between the inner end of the cylinder element 272 so as to define a chamber 280 between the diaphragm 278 and the bottom 282 of the recess. As in the previous arrangements an inlet passage 284 leads into the chamber 280 and an outlet exhaust passage 286 leads from the chamber.

An elastomer bellows seal 288 is connected between the external part of the piston 270 and the external part of the cylinder 272 and a sliding seal 290 is disposed between the inner periphery of the cylinder 272 and the piston 270.

The space between the outer bellows seal 288 and the inner diaphragm 278 is filled with a clean lubricating fluid such as oil and it will be appreciated that this does not at any time come into contact with the drilling fluid and remains uncontaminated. This prevents the loss of performance which such contamination could cause. The diaphragm 278 and bellows seal 288 may be formed from a fabric or other porous material so that any leakage of lubricating fluid may be made up by passage of drilling fluid through the material, which fluid is effectively filtered by its passage through the material.

As the chamber 280 is pressurised by being placed in communication with the central bore of the drill bit, the piston 270 is urged outwardly against the formation surrounding the borehole and when the chamber 280 is placed into communication with the annulus, via the exhaust bore 286, as described in relation to the earlier arrangement, the piston 270 moves inwardly. A pin and slot arrangement 292 is provided to limit the inward and outward movement of the piston 270.

Figure 29:
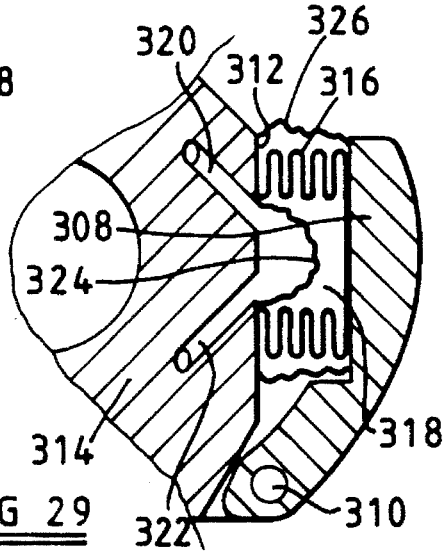
FIG. 29 is a similar view to FIG. 24 of a further form of modulated bias unit in accordance with the invention.

FIG. 29 shows a further form of actuator in which the moveable thrust member is again in the form of a paddle 308 pivotably mounted at 310 on the bit body. In this case the inner surface of the paddle 308 is connected to the bottom of a recess 312 in the bit body 314 by generally cylindrical metal bellows 316. The bellows define a variable volume cavity 318 between the bottom of the recess 312 and the inner surface of the paddle 308 and communicating with this cavity are an inlet passage 350 and outlet passage 322.

The flow of drilling fluid to and from the cavity 318 through the inlet passage 320 and outlet passage 322 is controlled in synchronism with rotation of the bias unit by suitable valve means in any of the ways previously described. When the cavity 318 is pressurised the paddle 308 is urged outwardly away from the body 314, and when the cavity 318 is placed in communication with the annulus the paddle is free to move inwardly.

In order to prevent debris entrained in the drilling fluid from fouling the peripheral surfaces of the metal bellows, the bellows may be enclosed between inner and outer flexible "bags" 324 and 326. Since the purpose of the bags is to prevent debris finding its way onto the metal bellows, the bags may be formed from woven fabric or other porous material. However, it will be appreciated that even if the bags are of non-porous material, such as an impervious elastomer, this will not interfere with the operation of the bellows 316, provided that the bags are of sufficient size to permit the appropriate extension and retraction of the bellows.

Figure 30:
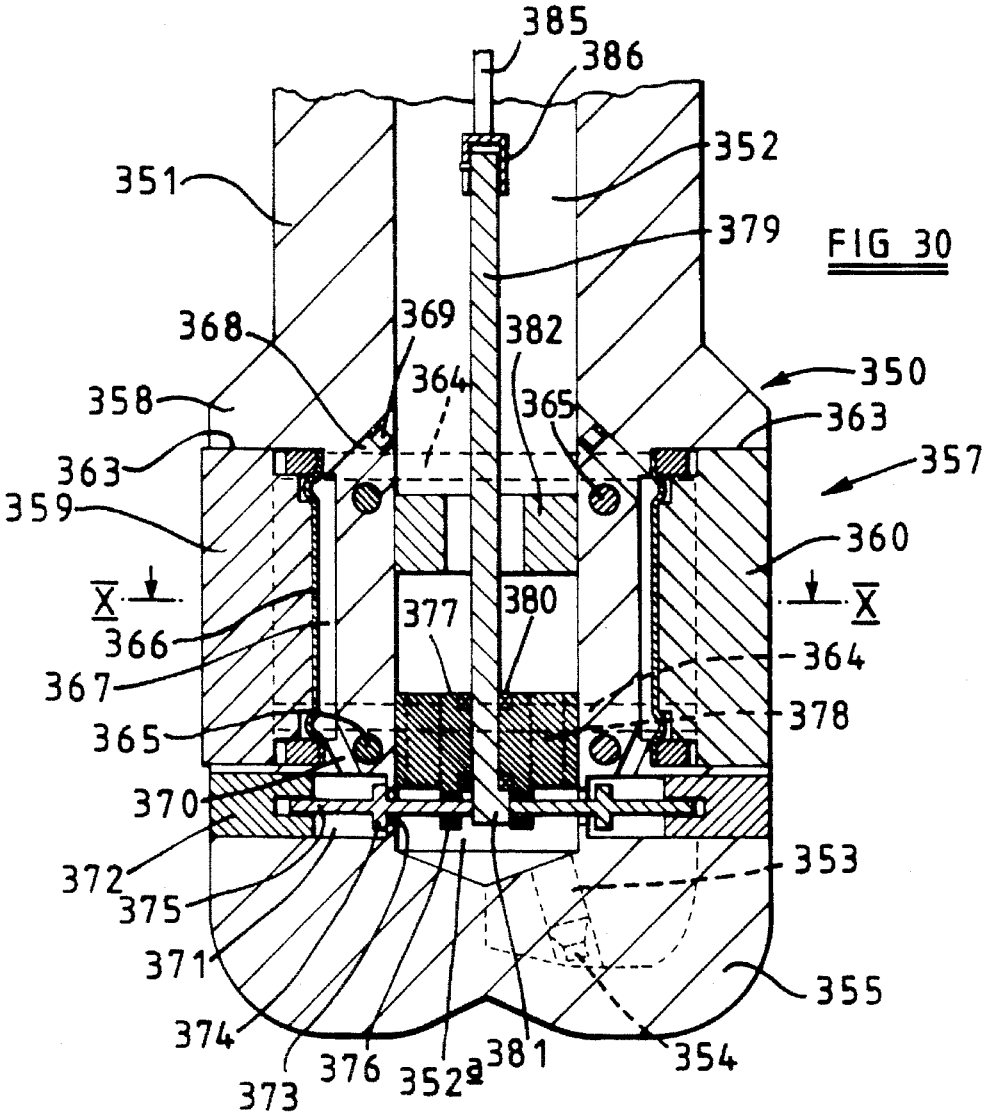
FIG. 30 is a diagrammatic longitudinal section through a steerable PDC drill bit incorporating a still further form of modulated bias unit according the invention.
Figure 31:
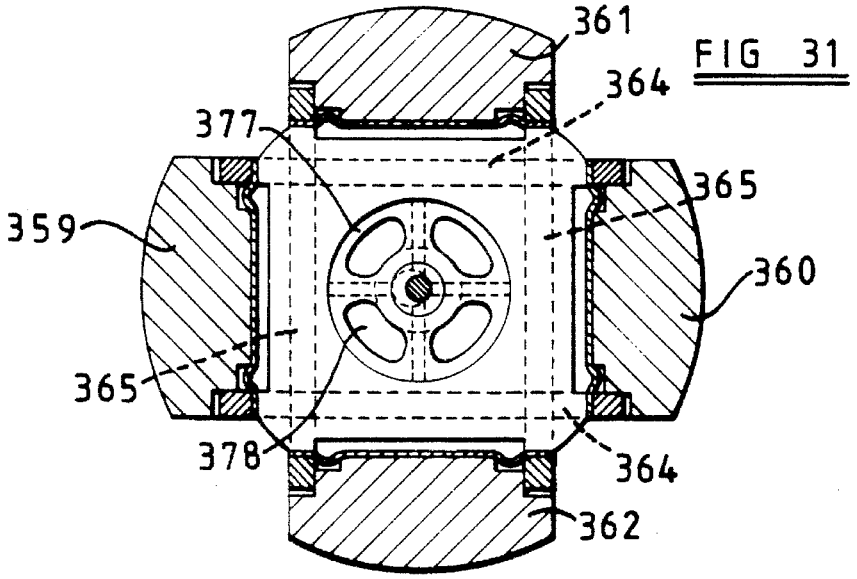
FIG. 31 is a cross-section through the drill bit of FIG. 31.

FIGS. 30 and 31 show diagrammatically a further form of PDC (polycrystalline diamond compact) drill bit incorporating a synchronous modulated bias unit, in accordance with the invention, for effecting steering of the bit during rotary drilling.

The drill bit comprises a bit body 350 having a shank 351 for connection to the drill string and a central passage 352 for supplying drilling fluid through bores, such as 353, to nozzles such as 354 in the face of the bit.

The face of the bit is formed with a number of blades 355, for example four blades, each of which carries, spaced apart along its length, a plurality of PDC cutters (not shown). Each cutter may be of the kind comprising a circular tablet, made up of a superhard table of polycrystalline diamond, providing the front cutting face, bonded to a substrate of cemented tungsten carbide. Each cutting element is brazed to a tungsten carbide post or stud which is received within a socket in the blade 355 on the bit body.

The gauge portion 357 of the bit body is formed with four circumferentially spaced kickers which, in use, engage the walls of the borehole being drilled and are separated by junk slots.

PDC drill bits having the features just described are generally well known and such features do not therefore require to be described or illustrated in further detail. The drill bit of FIGS. 30 and 31, however, incorporates a synchronous modulated bias unit according to the invention which allows the bit to be steered in the course of rotary drilling and the features of such bias unit will now be described.

Each of the four kickers 358 of the drill bit incorporates a piston assembly 359, 360, 361 or 362 which is slideable inwardly and outwardly in a matching bore 363 in the bit body. The opposite piston assemblies 359 and 360 are interconnected by four parallel rods 364 which are slideable through Correspondingly shaped guide bores through the bit body so that the piston assemblies are rigidly connected together at a constant distance apart. The other two piston assemblies 361 and 362 are similarly connected by rods 365 extending at right angles below the respective rods 364.

The outer surfaces of the piston assemblies 359, 360, 361, 362 are cylindrically curved in conformity with the curved outer surfaces of the kickers. The distance apart of opposed piston assemblies is such that when the outer surface of one assembly, such as the assembly 360 in FIG. 10, is flush with the surface of its kicker, the outer surface of the opposite assembly, such as 359 in FIG. 10, projects a short distance beyond the outer surface of its associated kicker.

Each piston assembly is separated from the inner end of the bore 363 in which it is slideable by a flexible diaphragm 366 so as to define an enclosed chamber 367 between the diaphragm and the inner wall of the bore 363. The upper end of each chamber 367 communicates through an inclined bore 368 with the central passage 352 in the bit body, a choke 369 being located in the bore 368.

The lower end of each chamber 367 communicates through a bore 370 with a cylindrical radially extending valve chamber 371 closed off by a fixed plug 372. An aperture 373 places the inner end of the valve chamber 371 in communication with a part 352*a* of the central passage 352 below a circular spider/choke 377 mounted in the passage 352. The aperture 373 is controlled by a popper valve 374 mounted on a rod 375. The inner end of each rod 375 is slidingly supported in a blind bore in the inner end of the plug 372.

The valve rod 375 extends inwardly through each aperture 373 and is supported in a sliding bearing 376 depending from the circular spider 377. The spider 377 has vertical through passages 378 to permit the flow of drilling fluid past the spider to the nozzles 354 in the bit face, and therefore also acts as a choke create a pressure drop in the fluid. A control shaft 379 extends axially through the centre of the spider 377 and is supported therein by bearings 380. The lower end of the control shaft 379 carries a cam member 381 which cooperates with the four valve rods 375 to operate the poppet valves 374.

The upper end of the control shaft 379 is detachably coupled to an output shaft 385 which is mounted axially on the carrier of a roll stabilised assembly of any of the kinds previously described. The coupling may be in the form of a mule shoe 386 which, as is well known, is a type of readily engageable and disengageable coupling which automatically connects two shafts in a predetermined relative rotational orientation to one another. One shaft 379 carries a transverse pin which is guided into an open-ended axial slot on a coupling member on the other shaft 385, by engagement with a peripheral cam surface on the coupling member. During steered directional drilling the shafts 385 and 379 remains substantially stationary at an angular orientation, in space, which is controlled by a roll stabilised package, as in arrangements previously described.

As the drill bit rotates relatively to the shaft 379 the cam member 381 opens and closes the four poppet valves 374 in succession. When a poppet valve 374 is open drilling fluid from the central passage 352 flows into the associated chamber 367 through the bore 368 and then flows out of the chamber 367 through the bore 370, valve chamber 371, and aperture 373 into the lower end 352*a* of the passage 352, which is at a lower pressure than the upper part of the passage due to the pressure drop caused by the spider 377 and a further choke 382 extending across the passage 352 above the spider 377. This throughflow of drilling fluid flushes any debris from the bores 368 and 370 and chamber 367.

The further choke 382 is replaceable, and is selected according to the total pressure drop required across the choke 382 and spider 377, having regard to the particular pressure and flow rate of the drilling fluid being employed.

As the drill bit rotates to a position where the poppet valve 374 is closed, the pressure in the chamber 367 rises causing the associated piston assembly to be displaced outwardly with respect to the bit body. Simultaneously, due to their interconnection by the rods 364 or 365, the opposed piston assembly is withdrawn inwardly to the position where it is flush with the outer surface of its associated kicker, such inward movement being permitted since the poppet valve associated with the opposed piston assembly will be open.

Accordingly, the displacement of the piston assemblies is modulated in synchronism with rotation of the bit body about the control shaft 379. As a result of the modulation of the displacement of the piston assemblies, a periodic lateral displacement is applied to the drill bit in a constant direction as the bit rotates, such direction being determined by the angular orientation of the shafts 385 and 379. The displacement of the drill bit, as rotary drilling proceeds, determines the direction of deviation of the borehole.

When it is required to drill without deviation, the control shafts 385, 379 are allowed to rotate in space, instead of being held at a required rotational orientation.

In certain of the arrangements described above, the flow of drilling fluid into and out of the cavity in each actuator takes place through a single passage. For example the embodiments of FIGS. 6 to 17 are of this type. In other arrangements, however, for example of the kind shown in FIGS. 20 to 31, drilling fluid under pressure is delivered to the cavity through an inlet passage and fluid escapes from the cavity to the annulus through a separate outlet or exhaust passage.

The latter arrangement is preferred since it tends to prevent debris entrained in the fluid settling and being retained within the cavity. In the more preferred arrangements the operation is such that, at some stage in each operation of the actuator, the inlet and exhaust passages are open simultaneously so that there is a flushing through of drilling fluid which washes away any debris. It will be appreciated that if debris were to be allowed to settle out and accumulate in the cavity, this would lead to eventual clogging of the cavity and perhaps non functioning of the bias unit.

Those arrangements described above having only a single combined inlet and outlet passage could be modified so as to provide, instead, separate inlet and outlet passages.

It should be emphasised that although, for convenience, the modulated bias systems described above have been shown incorporated in a special drill bit, the present invention includes arrangements where such modulated bias systems are not incorporated in the drill bit itself but are provided in a separate sub-unit designed to form a part of the bottomhole assembly above the drill bit, and thus to allow steerable rotary drilling with any existing or conventionally designed form of drill bit. Also, the invention is not exclusively for use with PDC drill bits, but a modulated bias unit according to the invention might be incorporated in, or used in combination with, a roller cone or natural diamond bit.

We claim:

1. A modulated bias unit, for controlling the direction of drilling of a rotary drill bit when drilling boreholes in subsurface formations, comprising:

a body structure having an outer peripheral surface;

at least one cavity located at and facing outwardly of said outer peripheral surface;

a movable thrust member partly projecting outwardly of said cavity for engagement with the surrounding formation of the borehole being drilled;

means for supplying fluid under pressure to said cavity from a source of fluid under pressure to displace said movable member outwardly and thereby displace the bias unit away from the region of the formation which the movable member engages; and means for modulating the pressure of fluid supplied to the cavity in synchronism with rotation of the body structure, and in selected phase relation thereto, whereby said movable member is displaced outwardly at a selected rotational orientation of the body structure; and a controllable input element coupled to said pressure modulating means, the condition of said input element determining the phase relation of the modulation of the fluid pressure to the rotation of the body structure, whereby said phase relation, and hence said rotational orientation at which said movable member is outwardly displaced, may be selected to any desired value by adjustment of the condition of said input element.

2. A modulated bias unit according to claim 1, wherein said means for modulating the pressure of fluid supplied to the cavity comprise valve means operable to place said cavity alternately in communication with an inlet flowpath leading from said source of fluid under pressure and an outlet flowpath leading to a lower pressure zone, in synchronism with rotation of the unit.

3. A modulated bias unit according to claim 1, comprising an inlet flowpath leading from said source of fluid under pressure to said cavity, an outlet flowpath leading from said cavity to a lower pressure zone, and valve means in at least one of said flowpaths operable in synchronism with rotation of the unit to modulate the pressure of fluid supplied to said cavity from said source.

4. A modulated bias unit according to claim 3, wherein the other of said inlet and outlet flowpaths includes choke means to effect a pressure drop in fluid flowing along said other flowpath.

5. A modulated bias unit according to claim 3, where said valve means are located in said inlet flowpath.

6. A modulated bias unit according to claim 3, wherein said inlet and outlet flowpaths are separate and include separate inlet and outlet passages leading into and out of said cavity respectively.

7. A modulated bias unit according to claim 1, wherein means are provided to constrain the movable thrust member to reciprocate linearly inwardly and outwardly with respect to said cavity.

8. A modulated bias unit, for controlling the direction of drilling of a rotary drill bit when drilling boreholes in subsurface formations, comprising;

a body structure having an outer peripheral surface;

a plurality of cavities spaced substantially equally apart around the outer peripheral surface of the body structure;

a movable thrust member partly projecting outwardly of each cavity for engagement with the surrounding formation of the borehole being drilled;

means for supplying fluid under pressure to said cavities from a source of fluid under pressure to displace said movable members outwardly; and means for modulating the pressure of fluid supplied to each cavity in synchronism with rotation of the body structure, and in selected phase relation thereto, whereby each said movable member is displaced outwardly at a selected rotational orientation of the body structure, said pressure modulating means comprising valve means operable to increase the pressure of fluid supplied to each cavity in succession, as the unit rotates.

9. A modulated bias unit according to claim 8, wherein said valve means comprise a plurality of separate valves, each located to control the supply of fluid under pressure to a different one of said cavities, means being provided to effect operation of each valve in succession, as the unit rotates.

10. A modulated bias unit according to claim 9, wherein the separate valve means controlling the supply of fluid under pressure to each cavity comprise an outlet in the respective movable thrust member which faces into the cavity and leads to an exhaust passage formed in the movable thrust member and leading to a lower pressure zone, and a reciprocable element located to move into and out of covering relation with said outlet as the bias unit rotates, whereby said movable thrust member is moved outwardly under the action fluid pressure in the cavity when the outlet is covered, and is free to move inwardly when the outlet is uncovered and vents fluid pressure from the cavity through said exhaust passage.

11. A modulated bias unit according to claim 10, wherein said reciprocable element is located at the outer end of an elongate element which extends generally radially of the bias unit, the inner end of the elongate element being coupled by a Scotch yoke mechanism to a control member coaxial with the bias unit, which control member remains substantially non-rotating as the bias unit rotates.

12. A modulated bias unit, for controlling the direction of drilling of a rotary drill bit when drilling boreholes in subsurface formations, comprising a body structure having an outer peripheral surface;

at least one cavity located at said outer peripheral surface;

a movable thrust member partly projecting outwardly of said cavity for engagement with the surrounding formation of the borehole being drilled;

means for supplying fluid under pressure to said cavity from a source of fluid under pressure to displace said movable member outwardly; and means for modulating the pressure of fluid supplied to the cavity in synchronism with rotation of the body structure, and in selected phase relation thereto, whereby said movable member is displaced outwardly at a selected rotation orientation of the body structure;

at least part of said cavity being defined by a flexible sealing element connected between the movable thrust member and the body structure of the unit, which cavity increases in volume as fluid under pressure is delivered thereto, so as to urge the movable thrust member outwardly with respect to the cavity;

said flexible sealing element comprising a metal bellows, one end of which is connected to an inner face of the movable thrust member and the opposite face of which is connected to a surface of the body structure around an inlet and outlet for fluid under pressure, whereby said cavity is defined by the metal bellows, said inner face of the movable thrust member and said surface of the body structure.

13. A modulated bias unit according to claim 12, wherein said shear seal, and the laminations thereof, are part-conical and are mounted between part-conical surfaces on the movable thrust member and recess respectively.

14. A modulated bias unit, for controlling the direction of drilling of a rotary drill bit when drilling boreholes in subsurface formations, comprising:

a body structure having an outer peripheral surface;

a plurality of cavities located at said outer peripheral surface;

a movable thrust member partly projecting outwardly of each cavity for engagement with the surrounding formation of the borehole being drilled;

means for supplying fluid under pressure to said cavities from a source of fluid under pressure to displace said movable member outwardly; and means for modulating the pressure of fluid supplied to each cavity in synchronism with rotation of the body structure, and in selected phase relation thereto, whereby said movable member is displaced outwardly at a selected rotational orientation of the body structure;

there being provided at least one pair of cavities and movable thrust members diametrically oppositely disposed with respect to the central longitudinal axis of the bias unit, the movable thrust members of each said pair being mechanically coupled together by connecting means extending through the body structure of the bias unit whereby as one thrust member moves outward the other thrust member moves inwardly by an equal amount and vice versa.

15. A modulated bias unit according to claim 14, wherein said connecting means comprise at least one connecting rod extending slidably through bearing means within the body structure, opposite ends of each rod being connected to the two thrust members respectively.

16. A modulated bias unit, for controlling the direction of drilling of a rotary drill bit when drilling boreholes in subsurface formations comprising:

a body structure having an outer periphery;

a plurality of hydraulic actuator units spaced apart around the periphery of the body structure and having movable thrust members hydraulically displaceable outwardly with respect to the body structure for engagement with the formation of the borehole being drilled;

each actuator unit having an inlet passage for connection to a source of fluid under pressure and an outlet passage for communication with a lower pressure zone;

selector valve means for connecting said inlet passages in succession to said source of fluid under pressure, as the unit rotates;

choke means to create a pressure drop between the source of fluid under pressure and said selector valve means; and further choke means in the outlet passage from each actuator unit.

17. A modulated bias unit, for controlling the direction of drilling of a rotary drill bit when drilling boreholes in subsurface formations comprising:

a body structure having an outer periphery;

a plurality of hydraulic actuator units spaced apart around the periphery of the body structure and having movable thrust members hydraulically displaceable outwardly with respect to the body structure for engagement with the formation of the borehole being drilled;

each actuator unit having an inlet passage for connection to a source of fluid under pressure and an outlet passage for communication with a lower pressure zone;

valve means in one of the inlet and outlet passages of each actuator unit;

choke means in the other of the inlet and outlet passages of each actuator unit; and means for selectively operating said valve means in succession as the bias unit rotates, to place the hydraulic actuators successively in communication with the source of fluid under pressure.

18. A modulated bias unit according to claim 17, wherein said choke means comprise further valve means, means being provided for selectively operating said further valve means in succession as the bias unit rotates.

19. A modulated bias unit according to claim 17, including further choke means to create a pressure drop between the source of fluid under pressure and said inlet passages of the actuator units.

20. A drill bit for drilling boreholes in subsurface formations comprising a bit body having an outer peripheral surface and a shank for connection to a drill string, an inner passage for supply drilling fluid under pressure to the bit, and a plurality of cutting elements mounted on the bit body, the bit body including a modulated bias unit comprising: a plurality of hydraulic actuator units spaced apart around the peripheral surface of the body and having movable thrust members hydraulically displaceable outwardly with respect to the bit body for engagement with the formation of the borehole being drilled; each actuator unit having an inlet passage for connection to said inner passage and an outlet passage for communication with the annulus between the bit body and the borehole being drilled; selector valve means for connecting said inlet passages in succession to said inner passage as the drill bit rotates; choke means to create a pressure drop between the inner passage and said selector valve means; and further choke means in the outlet passage from each actuator unit.

21. A modulated bias unit, for controlling the direction of drilling of a rotary drill bit when drilling boreholes in subsurface formations, comprising:

a body structure having an outer peripheral surface;

at least one cavity located at said outer peripheral surface;

a movable thrust member partly projecting outwardly of said cavity for engagement with the surrounding formation of the borehole being drilled;

means for supplying fluid under pressure to said cavity from a source of fluid under pressure to displace said movable member outwardly; and means for modulating the pressure of fluid supplied to the cavity in synchronism with rotation of the body structure, and in selected phase relation thereto, whereby said movable member is displaced outwardly at a selected rotational orientation of the body structure;

said pressure modulating means comprising valve means operable by a shaft which extends at least partly into a region providing said source of fluid under pressure, a flowpath leading from said region to the valve means including an annular choke to effect a pressure drop in fluid flowing along said flowpath, and said shaft extending through said choke.

22. A modulated bias unit, for controlling the direction of drilling of a rotary drill bit when drilling boreholes in subsurface formations, comprising:

a body structure having an outer peripheral surface;

at least one cavity located at said outer peripheral surface;

a movable thrust member partly projecting outwardly of said cavity for engagement with the surrounding formation of the borehole being drilled;

means for supplying fluid under pressure to said cavity from a source of fluid under pressure to displace said movable member outwardly;

means for modulating the pressure of fluid supplied to the cavity in synchronism with rotation of the body structure, and in selected phase relation thereto, whereby said movable member is displaced outwardly at a selected rotational orientation of the body structure; and means to constrain the movable thrust member to reciprocate linearly inwardly and outwardly with respect to said cavity, the movable thrust member being constrained to reciprocate along an axis which is parallel to a radius of the bias unit but is spaced rearwardly from said radius with respect to the direction of rotation of the unit during drilling, whereby said axis does not intersect the axis of rotation of the bias unit.

23. A modulated bias unit, for controlling the direction of drilling of a rotary drill bit when drilling boreholes in subsurface formations, comprising:

a body structure having an outer peripheral surface;

at least one cavity located at said outer peripheral surface;

a movable thrust member partly projecting outwardly of said cavity for engagement with the surrounding formation of the borehole being drilled;

means for supplying fluid under pressure to said cavity from a source of fluid under pressure to displace said movable member outwardly; and means for modulating the pressure of fluid supplied to the cavity in synchronism with rotation of the body structure, and in selected phase relation thereto, whereby said movable member is displaced outwardly at a selected rotational orientation of the body structure;

at least part of said cavity being defined by a flexible sealing element connected between the movable thrust member and the body structure of the unit, which cavity increases in volume as fluid under pressure is delivered thereto, so as to urge the movable thrust member outwardly with respect to the cavity;

said flexible sealing element comprising an annular element of generally c-shaped cross-section, one face of which is connected to an inner face of the movable thrust member and the opposite face of which is connected to a surface of the body structure, around an inlet and outlet for fluid under pressure, whereby said cavity is defined by the annular element, said inner face of the movable thrust member and said surface of the body structure.

24. A modulated bias unit, for controlling the direction of drilling of a rotary drill bit when drilling boreholes in subsurface formations, comprising;

a body structure having an outer peripheral surface;

at least one cavity located at said outer peripheral surface;

a movable thrust member partly projecting outwardly of said cavity for engagement with the surrounding formation of the borehole being drilled;

means for supplying fluid under pressure to said cavity from a source of fluid under pressure to displace said movable member outward; and means for modulating the pressure of fluid supplied to the cavity in synchronism with rotation of the body structure, and in selected phase relation thereto, whereby said movable member is displaced outwardly at a selected rotational orientation of the body structure;

at least part of said cavity being defined by a flexible sealing element connected between the movable thrust member and the body structure of the unit, which cavity increases in volume as fluid under pressure is delivered thereto, so as to urge the movable thrust member outwardly with respect to the cavity;

said flexible sealing element comprising a diaphragm connected between the movable thrust member and a surrounding wall of a recess in the body structure.

25. A modulated bias unit, for controlling the direction of drilling of a rotary drill bit when drilling boreholes in subsurface formations, comprising:

a body structure having an outer peripheral surface;

at least one cavity located at said outer peripheral surface;

a movable thrust member, partly projecting outwardly of said cavity, for engagement with the surrounding formation of the borehole being drilled;

means for supplying fluid under pressure to said cavity from a source of fluid under pressure to displace said movable member outwardly;

means for modulating the pressure of fluid supplied to the cavity in synchronism with rotation of the body structure, and in selected phase relation thereto, whereby said movable member is displaced outwardly at a selected rotational orientation of the body structure;

an inlet flowpath leading from said source of fluid under pressure to said cavity, said means for modulating the pressure of fluid supplied to the cavity, said means for modulating the pressure of fluid supplied to the cavity comprising rotary valve means in said inlet flowpath operable in synchronism with rotation of the unit to modulate the pressure of fluid supplied to said cavity from said source; and a valve control input shaft coupled to said rotary valve means so that said selected phase relation is determined by the rotational orientation of said input shaft.

26. A modulated bias unit, for controlling the direction of drilling of a rotary drill bit when drilling boreholes in subsurface formations, comprising:

a body structure having an outer peripheral surface;

a plurality of cavities spaced substantially equally apart around the outer peripheral surface of the body structure;

a movable thrust member partly projecting outwardly of each cavity for engagement with the surrounding formation of the borehole being drilled;

means for supplying fluid under pressure to said cavities from a source of fluid under pressure to displace said movable members outwardly; and means for modulating the pressure of fluid supplied to each cavity in synchronism with rotation of the body structure, and in selected phase relation thereto, whereby each said movable member is displaced outwardly at a selected rotational orientation of the body structure, said pressure modulating means comprising valve means operable to increase the pressure of fluid supplied to each cavity in succession, as the unit rotates, said valve means comprising a single selector valve adapted to connect an inlet, leading from said source of fluid under pressure, to each one in succession of a plurality of outlets, each of which outlets leads to a different one of said cavities.

27. A modulated bias unit according to claim 26, wherein said selector valve is a disc valve.

28. A modulated bias unit for controlling the direction of drilling of a rotary drill bit when drilling boreholes in subsurface formations, comprising:

a body structure having an outer peripheral surface;

at least one cavity located at and facing outwardly of said outer peripheral surface;

a movable thrust member partly projecting outwardly of said cavity for engagement with the surrounding formation of the borehole being drilled;

said movable thrust member being pivotally mounted on the body structure for pivotal movement about a pivot axis located to one side of said cavity;

means for supplying fluid under pressure to said cavity from a source of fluid under pressure to displace said movable member outwardly and thereby displace the bias unit away from the region of the formation which the movable member engages;

means for modulating the pressure of fluid supplied to the cavity in synchronism with rotation of the body structure, and in selected phase relation thereto, whereby said movable member is displaced outwardly at a selected rotational orientation of the body structure; and a controllable input element coupled to said pressure modulating means, the condition of said input element determining the phase relation of the modulation of the fluid pressure to the rotation of the body structure, whereby said phase relation, and hence said rotational orientation at which said movable member is outwardly displaced, may be selected to any desired value by adjustment of the condition of said input element.

29. A modulated bias unit according to claim 28, wherein said pivot axis of the movable thrust member extends generally parallel to the axis of rotation of the modulated bias unit during drilling.

30. A modulated bias unit according to claim 29, wherein said pivot axis is disposed on the leading side of the cavity with respect to the direction of rotation of the modulated bias unit during drilling.

31. A modulated bias unit, for controlling the direction of drilling of a rotary drill bit when drilling boreholes in subsurface formations, comprising:

a body structure having an outer peripheral surface;

at least one cavity located at said outer peripheral surface;

a movable thrust member partly projecting outwardly of said cavity for engagement with the surrounding formation of the borehole being drilled;

said movable thrust member including a piston portion which is slidable within a cylinder portion communicating with said cavity;

means for supplying fluid under pressure to said cavity from a source of fluid under pressure to displace said movable member outwardly; and means for modulating the pressure of fluid supplied to the cavity in synchronism with rotation of the body structure, and in selected phase relation thereto, whereby said movable member is displaced outwardly at a selected rotational orientation of the body structure;

said cylinder portion constraining the piston portion of the movable thrust member to reciprocate linearly inwardly and outwardly with respect to said cavity, the movable thrust member being constrained to reciprocate along an axis which is parallel to a radius of the bias unit but is spaced rearwardly from said radius with respect to the direction of rotation of the unit during drilling, whereby said axis does not intersect the axis of rotation of the bias unit.

32. A modulated bias unit according to claim 31, wherein flexible seals are provided at inner and outer ends of said cylinder portion to isolate the sliding engagement between the piston portion and cylinder portion from fluid both in the cavity and externally of the bias unit.

33. A modulated bias unit according to claim 32, wherein the spaces enclosed between said flexible seals are filled with lubricating fluid.

34. A modulated bias unit, for controlling the direction of drilling of a rotary drill bit when drilling boreholes in subsurface formations, comprising;

a body structure having an outer peripheral surface;

at least one cavity located at said outer peripheral surface;

a movable thrust member partly projecting outwardly of said cavity for engagement with the surrounding formation of the borehole being drilled;

means for supplying fluid under pressure to said cavity from a source of fluid under pressure to displace said movable member outwardly; and means for modulating the pressure of fluid supplied to the cavity in synchronism with rotation of the body structure, and in selected phase relation thereto, whereby said movable member is displaced outwardly at a selected rotational orientation of the body structure;

at least part of said cavity being defined by a flexible sealing element connected between the movable thrust member and the body structure of the unit, which cavity increases in volume as fluid under pressure is delivered thereto, so as to urge the movable thrust member outwardly with respect to the cavity;

said flexible sealing element comprising a diaphragm connected between the movable thrust member and a surrounding wall of a recess in the body structure, said diaphragm being a rolling diaphragm having an annular portion of elongate U-shaped cross-section between the movable thrust member and said surrounding wall of said cavity.

35. A modulated bias unit, for controlling the direction of drilling of a rotary drill bit when drilling boreholes in subsurface formations comprising:

a body structure having an outer peripheral surface;

at least one cavity located at and facing outwardly of said outer peripheral surface;

a movable thrust member partly projecting outwardly of said cavity for engagement with the surrounding formation of the borehole being drilled;

means for supplying fluid under pressure to said cavity from a source of fluid under pressure to displace said movable member outwardly and thereby displace the bias unit away from the region of the formation which the movable member engages; and means for modulating the pressure of fluid supplied to the cavity in synchronism with rotation of the body structure, and in selected phase relation thereto, whereby said movable member is displaced outwardly at a selected rotational orientation of the body structure; and a controllable input element coupled to said pressure modulating means, the condition of said input element determining the phase relation of the modulation of the fluid pressure to the rotation of the body structure, whereby said phase relation, and hence said rotational orientation at which said movable member is outwardly displaced, may be selected to any desired value by adjustment of the condition of said input element;

said movable thrust member being formed in two pans comprising an outer part pivotally mounted on said body structure for pivotal movement about a pivot axis located to one side of said cavity, and for engagement with the surrounding formation of the borehole being drilled, and an inner part which is subjected to the pressure of fluid in said cavity and is movable outwardly under the action of said pressure, the inner pan being operatively engaged with the outer part whereby outward movement of the inner part is accompanied by outward movement of the outer part.

* * * * *